US008814647B2

(12) United States Patent
Palmer et al.

(10) Patent No.: US 8,814,647 B2
(45) Date of Patent: Aug. 26, 2014

(54) GAMING DEVICE AND METHOD OF OPERATING A GAMING DEVICE INCLUDING PLAYER CONTROLLED TARGETING

(75) Inventors: David M. Palmer, Reno, NV (US); Michael N. Low, Sparks, NV (US)

(73) Assignee: IGT, Las Vegas, NV (US)

( * ) Notice: Subject to any disclaimer, the term of this patent is extended or adjusted under 35 U.S.C. 154(b) by 1405 days.

(21) Appl. No.: 11/688,056

(22) Filed: Mar. 19, 2007

(65) Prior Publication Data

US 2008/0234021 A1 Sep. 25, 2008

(51) Int. Cl.
*A63F 9/24* (2006.01)
*G07F 17/32* (2006.01)
*G07F 17/38* (2006.01)

(52) U.S. Cl.
CPC ..... *G07F 17/3295* (2013.01); *G07F 17/32* (2013.01); *G07F 17/38* (2013.01); *G07F 17/3262* (2013.01)
USPC ..... 463/16; 463/2; 463/20; 463/49; 463/53

(58) Field of Classification Search
CPC ... G07F 17/3262; G07F 17/38; A63F 9/0291; A63F 2300/8076
USPC ..... 463/2, 5, 7, 16, 18, 20, 21, 49, 53, 56
See application file for complete search history.

(56) References Cited

U.S. PATENT DOCUMENTS 1,854,479 A 4/1932 Mills
4,363,485 A 12/1982 Edwall
4,582,324 A 4/1986 Koza et al.
4,618,150 A 10/1986 Kimura
4,652,998 A 3/1987 Koza et al.
4,695,053 A 9/1987 Vazquez, Jr. et al.
4,743,024 A 5/1988 Helm et al.
4,773,647 A 9/1988 Okada et al.

(Continued)

FOREIGN PATENT DOCUMENTS

EP 375190 A2 6/1990
EP 0688002 A1 12/1995

(Continued)

OTHER PUBLICATIONS

"Believe It or Not ," Article written by Frank Legato, published in Strictly Slots in Jun. 2001.

(Continued)

*Primary Examiner* — Jay Trent Liddle
(74) *Attorney, Agent, or Firm* — Neal Gerber & Eisenberg LLP

(57) ABSTRACT

A gaming machine, system, and method including a game event in which a player aims at a target. In one embodiment, the game event includes a plurality of targets. The gaming device displays the plurality of targets to the player and enables the player to select one of the targets. The gaming device designates the player-selected target as the primary target for the game event. Based on the designated primary target, the gaming device identifies one or more of the other targets as secondary targets for the game event. The gaming device determines for each of the primary and secondary targets a probability that that target will be hit in the game event. The gaming device determines which of the targets is actually hit in the game event based on the probabilities associated with the targets.

57 Claims, 15 Drawing Sheets

(56) References Cited

U.S. PATENT DOCUMENTS

| | | | | |
|---|---|---|---|---|
| 5,116,055 | A | 5/1992 | Tracy | |
| 5,280,909 | A | 1/1994 | Tracy | |
| 5,308,065 | A | 5/1994 | Bridgeman et al. | |
| 5,340,317 | A | 8/1994 | Freeman | |
| 5,342,047 | A | 8/1994 | Heidel et al. | |
| 5,342,049 | A | 8/1994 | Wichinsky et al. | |
| 5,344,144 | A | 9/1994 | Canon | |
| 5,393,061 | A | 2/1995 | Manship | |
| 5,411,271 | A | 5/1995 | Mirando | |
| 5,524,888 | A | 6/1996 | Heidel | |
| 5,542,669 | A | 8/1996 | Charron et al. | |
| 5,560,603 | A | 10/1996 | Seelig et al. | |
| 5,601,487 | A * | 2/1997 | Oshima et al. | 463/4 |
| 5,611,730 | A | 3/1997 | Weiss | |
| 5,766,074 | A | 6/1998 | Cannon et al. | |
| 5,769,716 | A | 6/1998 | Saffari et al. | |
| 5,772,509 | A | 6/1998 | Weiss | |
| 5,779,549 | A | 7/1998 | Walker et al. | |
| 5,788,573 | A | 8/1998 | Baerlocher et al. | |
| 5,823,873 | A | 10/1998 | Moody | |
| 5,823,874 | A | 10/1998 | Adams | |
| 5,833,536 | A | 11/1998 | Davids et al. | |
| 5,848,932 | A | 12/1998 | Adams | |
| 5,873,781 | A | 2/1999 | Keane | |
| 5,882,259 | A | 3/1999 | Holmes et al. | |
| 5,882,261 | A | 3/1999 | Adams | |
| 5,910,046 | A | 6/1999 | Wada et al. | |
| 5,911,418 | A | 6/1999 | Adams | |
| 5,941,770 | A | 8/1999 | Miers et al. | |
| 5,951,397 | A | 9/1999 | Dickinson | |
| 5,967,894 | A | 10/1999 | Kinoshita et al. | |
| 5,997,401 | A | 12/1999 | Crawford | |
| 6,015,346 | A | 1/2000 | Bennett | |
| 6,019,369 | A | 2/2000 | Nakagawa et al. | |
| 6,033,307 | A | 3/2000 | Vancura | |
| 6,047,963 | A | 4/2000 | Pierce et al. | |
| 6,050,895 | A | 4/2000 | Luciano, Jr. et al. | |
| 6,056,642 | A | 5/2000 | Bennett | |
| 6,071,192 | A | 6/2000 | Weiss | |
| 6,089,976 | A | 7/2000 | Schneider et al. | |
| 6,089,977 | A | 7/2000 | Bennett | |
| 6,089,978 | A | 7/2000 | Adams | |
| 6,102,798 | A | 8/2000 | Bennett | |
| 6,110,039 | A | 8/2000 | Oh | |
| 6,110,041 | A | 8/2000 | Walker et al. | |
| 6,117,007 | A | 9/2000 | Matsuyama et al. | |
| 6,117,008 | A | 9/2000 | Machiguchi | |
| 6,120,031 | A | 9/2000 | Adams | |
| 6,126,165 | A | 10/2000 | Sakamoto | |
| 6,126,541 | A | 10/2000 | Fuchs | |
| 6,126,547 | A | 10/2000 | Ishimoto | |
| 6,135,884 | A | 10/2000 | Hedrick et al. | |
| 6,135,885 | A | 10/2000 | Lermusiaux | |
| 6,139,013 | A | 10/2000 | Pierce et al. | |
| 6,142,873 | A | 11/2000 | Weiss et al. | |
| 6,142,874 | A | 11/2000 | Kodachi et al. | |
| 6,146,273 | A | 11/2000 | Olsen | |
| 6,159,095 | A | 12/2000 | Frohm et al. | |
| 6,159,097 | A | 12/2000 | Gura | |
| 6,165,070 | A | 12/2000 | Nolte et al. | |
| 6,174,233 | B1 | 1/2001 | Sunaga et al. | |
| 6,174,234 | B1 | 1/2001 | Seibert et al. | |
| 6,174,235 | B1 | 1/2001 | Walker et al. | |
| 6,190,255 | B1 | 2/2001 | Thomas et al. | |
| 6,203,010 | B1 | 3/2001 | Jorasch et al. | |
| 6,210,279 | B1 | 4/2001 | Dickinson | |
| 6,217,022 | B1 | 4/2001 | Astaneha | |
| 6,220,593 | B1 | 4/2001 | Pierce et al. | |
| 6,220,961 | B1 | 4/2001 | Keane et al. | |
| 6,224,482 | B1 | 5/2001 | Bennett | |
| 6,231,442 | B1 | 5/2001 | Mayeroff | |
| 6,231,445 | B1 | 5/2001 | Acres | |
| 6,238,288 | B1 | 5/2001 | Walker et al. | |
| 6,251,013 | B1 | 6/2001 | Bennett | |
| 6,261,177 | B1 | 7/2001 | Bennett | |
| 6,267,669 | B1 | 7/2001 | Luciano, Jr. et al. | |
| 6,270,409 | B1 | 8/2001 | Shuster | |
| 6,270,411 | B1 | 8/2001 | Gura et al. | |
| 6,287,194 | B1 | 9/2001 | Okada et al. | |
| 6,293,866 | B1 | 9/2001 | Walker et al. | |
| 6,302,790 | B1 | 10/2001 | Brossard | |
| 6,309,298 | B1 | 10/2001 | Gerow | |
| 6,309,299 | B1 | 10/2001 | Weiss | |
| 6,315,660 | B1 | 11/2001 | DeMar et al. | |
| 6,364,768 | B1 | 4/2002 | Acres et al. | |
| 6,416,409 | B1 | 7/2002 | Jordan | |
| 6,435,511 | B1 | 8/2002 | Vancura et al. | |
| 6,439,995 | B1 | 8/2002 | Hughs-Baird et al. | |
| 6,443,837 | B1 | 9/2002 | Jaffe et al. | |
| 6,488,580 | B1 | 12/2002 | Robb | |
| 6,537,150 | B1 | 3/2003 | Luciano et al. | |
| 6,569,015 | B1 | 5/2003 | Baerlocher et al. | |
| 6,572,473 | B1 | 6/2003 | Baerlocher | |
| 6,582,306 | B1 | 6/2003 | Kaminkow | |
| 6,604,008 | B2 | 8/2003 | Chudley et al. | |
| 6,761,632 | B2 | 7/2004 | Bansemer et al. | |
| 6,763,273 | B2 | 7/2004 | Chudley et al. | |
| 6,780,103 | B2 | 8/2004 | Bansemer et al. | |
| 6,857,959 | B1 * | 2/2005 | Nguyen | 463/25 |
| 6,869,363 | B2 * | 3/2005 | Okitsu et al. | 463/29 |
| 7,018,292 | B2 | 3/2006 | Tracy et al. | |
| 7,056,210 | B2 | 6/2006 | Bansemer et al. | |
| 7,175,524 | B2 | 2/2007 | Bansemer et al. | |
| 7,285,049 | B1 * | 10/2007 | Luciano et al. | 463/42 |
| 2002/0049084 | A1 | 4/2002 | Hughs-Baird et al. | |
| 2002/0059252 | A1 | 5/2002 | Yamaguchi | |
| 2002/0115485 | A1 * | 8/2002 | Muir et al. | 463/20 |
| 2003/0013519 | A1 | 1/2003 | Bennett | |
| 2003/0027619 | A1 * | 2/2003 | Nicastro, Sr. | 463/16 |
| 2003/0114208 | A1 * | 6/2003 | Lorant | 463/7 |
| 2004/0048659 | A1 * | 3/2004 | Seelig et al. | 463/25 |
| 2004/0116173 | A1 | 6/2004 | Baerlocher | |
| 2005/0113162 | A1 * | 5/2005 | Olive et al. | 463/16 |
| 2006/0025201 | A1 * | 2/2006 | Van Asdale | 463/20 |
| 2006/0199626 | A1 * | 9/2006 | Ortiz et al. | 463/2 |
| 2006/0205474 | A1 | 9/2006 | Bansemer et al. | |
| 2006/0258434 | A1 * | 11/2006 | Jaffe et al. | 463/16 |
| 2007/0129133 | A1 | 6/2007 | Bansemer et al. | |
| 2007/0238503 | A1 | 10/2007 | Kowell | |

FOREIGN PATENT DOCUMENTS

| | | | |
|---|---|---|---|
| GB | 2 096 376 | A | 10/1982 |
| GB | 2 097 160 | A | 10/1982 |
| GB | 2 100 905 | A | 1/1983 |
| GB | 2 137 392 | A | 10/1984 |
| GB | 2 142 457 | A | 1/1985 |
| GB | 2 144 644 | A | 3/1985 |
| GB | 2 153 572 | A | 8/1985 |
| GB | 2 161 008 | A | 1/1986 |
| GB | 2 161 009 | A | 1/1986 |
| GB | 2 170 636 | A | 8/1986 |
| GB | 2 180 682 | A | 4/1987 |
| GB | 2 181 589 | A | 4/1987 |
| GB | 2 183 882 | A | 6/1987 |
| GB | 2 222 712 | A | 3/1990 |
| GB | 2 226 436 | A | 6/1990 |
| GB | 2 226 907 | A | 7/1990 |
| GB | 2 262 642 | A | 6/1993 |

OTHER PUBLICATIONS

Cash Chameleon Article, written by Aristocrat Technologies, published in Apr. 2001.

"The Classic Sitcoms Guide to . . . I Love Lucy—Season Two: 1952-53," [online] [printed on Dec. 9, 2003]. Retrieved from the Internet at <URL: http://classicsitcoms.com/shows/lucy2.html>.

Cyclone Advertisement, by Innovative Concepts in Entertainment, Inc., available in 1995, in or before December thereof.

Description of Gaming Machine with Animating Symbols, written by IGT, available in Jan. 2000.

Elvis Brochure, written by IGT, published in 1999, in or before December thereof.

(56) References Cited

OTHER PUBLICATIONS

Fey, Marshall "Slot Machines," published by Reno-Tahoe Specialty, Inc. In 1989, in or before December thereof.
"Hoyle's Rules of Games, Descriptions of Indoor Games of Skill and Chance, with Advice on Skillful Play. Based on the Foundations laid down by Edmond Hoyle, 1672-1769." Edited by Albert H. Morehead and Geoffrey Mott-Smith published 1946-1983.
"I Love Lucy—Episode Guide," [online] [printed on Dec. 9, 2003]. Retrieved from the Internet at <URL: http://www.tvtome.com/ILoveLucy/season2.html>.
"I Love Lucy Episode Guide-Job Switching ("Candy Factory")" [online] [printed on Dec. 9, 2003]. Retrieved from the Internet at <URL: http:www.youns.com/lucy/lovelucy.asp?offset=38>.
"Instant Slotto," Article written by Frank Legato, published by Strictly Slots in Apr. 2001.
"Introducing the Hottest Video Games on the Nile," written by Aristocrat Technologies, published in Oct. 2000.
Jackpot Party Brochures and Articles published by WMS Gaming Inc. in Mar. 1998.
"Mountain Coin Machine Distributing—Redemption Games—Cyclone™," [online] [printed on Feb. 28, 2002]. Retrieved from the Internet at <URL: http://www.mountaincoin.com/ice/cyclone.html>.
"Press Your Luck Original Game Show Page," written by Ottinger et al., [online] [printed on Apr. 25, 2002]. Retrieved from the Internet at <URL: http://wysiwyg://67/http://www.geocities.com/TelevisionCity/Set/7880/RULES/PYI.html>.
"Press Your Luck," Article written by Shuffle Master Gaming, published by Strictly Slots in Dec. 2000.
Primetime Amusements Redemption Games [online] [printed on Feb. 28, 2002]. Retrieved from the Internet at <URL:http://www.primetimeamusements.com/redemption.htm>.
"Reel em In®—Cast for Cash™," Brochure published by WMS Gaming, Inc. in 2001, in or before December thereof.
"Roll that Board," [online] [printed May 13, 2004]: Retrieved from the Internet at <URL: http://gscentral.net/board.htm>.
"Tickets'n'Tunes," [online] [printed on Feb. 28, 2002]. Retrieved from the Internet at <URL: http://www.rgb.com.my/amusemet-ice.html>.
Top Dollar Brochure written by IGT published in 1998, in or before December thereof.
"Weiner Distributing ICE Cyclone," [online] [printed on Feb. 28, 2002]. Retrieved from the Internet at <URL: http://www.weinerd.com/redemption-cyclone.htm>.
Winning Bid™ Brochure published by WMS Gaming, Inc. in 2001, in or before December thereof.

* cited by examiner

GAMING DEVICE AND METHOD OF OPERATING A GAMING DEVICE INCLUDING PLAYER CONTROLLED TARGETING

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Primary wagering games of gaming machines in most jurisdictions are games of luck, not games of skill. For instance, in slot machines, the player must make a wager on the slot game to begin the slot game, and the gaming machine randomly determines the outcome for the slot game. The outcome may be a winning outcome or a losing outcome. The outcome determines whether the player obtains an award according to the paytable of the slot machine.

One reason slot machines are popular is because an amateur, novice or inexperienced player can play most slot machines at the player's own pace, with no required skills, strategy or risk evaluation and perform as well as a seasoned or experienced slot game player. Most slot machines are set to pay back on average between 80 and 99 percent of the amounts that the players wager. In most modern slot machines, a processor controlling the gaming machine randomly determines the outcomes and thus the awards. In other slot machines, a central server determines the awards and sends information or data regarding the awards to the respective gaming machines.

Certain gaming machines such as video poker and blackjack involve certain player strategy or decision-making. The player decides which cards to hold in draw-type poker games and decides whether to take additional cards in blackjack-type card games. These games generally require a certain level of strategy to be successful.

Wagering games of gaming machines in certain jurisdictions are required to involve a skill event such as an event requiring player dexterity to be successful. These games cannot turn purely upon a random outcome. These gaming machines require strategy or timing of inputs by the player to determine success and failure. If the player does not play optimally, the actual payout percentage of the gaming machine will likely decrease accordingly.

Primary wagering games which are purely skill games or partial skill games present certain problems for game designers and gaming establishments. First, skill games can be mastered by players having a high level of skill, substantial practice or both. To combat the mastering of such games and to make the economics work, a game designer may have to make the skill game relatively difficult. The difficulty level may be too great for inexperienced or average players to have a sufficient level of success and enjoyment at the gaming machines. Such players may not have a favorable gaming experience at such gaming machines.

Skill games, on the other hand, are generally interactive and are enjoyable for certain people to play. Many people have especially grown accustomed to and comfortable with playing arcade skill games, home video skill games, computer skill games, handheld device skill games, and data network (e.g., internet) skill games. Many known wagering games do not appeal to such people who have played such skill based games which reward skill and strategy. Some of these people may not want to play wagering games of conventional gaming machines which are purely based on randomly generated outcomes and involve no skill or little skill. Some of these people also enjoy the competitive nature of skill games which are not provided by known conventional wagering games of gaming machines.

Accordingly, there is a continuing need to provide gaming devices and gaming systems which simulate games of skill in a way that enables a player to have some control over the outcome.

SUMMARY

The present disclosure provides a gaming system, gaming machine, and method that combines skill and chance to determine the outcome of an event in a game. More specifically, the present disclosure provides a game including a game event that mimics or appears to be an action or event requiring skill. The gaming device or system enables a player to make a choice or decision that has a direct impact on the player's chance of obtaining a desired outcome in the game.

In one embodiment, the gaming device provides a game including a game event having a plurality of possible different outcomes. The gaming device enables the player to input at least one choice or decision for the game event. In particular, the gaming device enables the player to select a desired one of the outcomes. Upon receiving the player's decision, the gaming device determines and assigns a probability to each of the outcomes based on the player's selection. The probability assigned to each of the outcomes represents the chance that that outcome will actually occur in the game event. The gaming device displays the game event and provides to the player any award associated with the outcome that actually occurs in the game event. The award may be any item of value, such as a monetary award or credits, points that the game adds to a total score, a bonus game, or any other suitable award.

It should be appreciated that the game may be any suitable game involving a game event that mimics a skill event, such as hand-eye coordination events or dexterity events. The game may include any suitable type and number of events. For example, the game may be any suitable type competitive game, a sports-based game, or a shooting game. In certain embodiments, the game involves mental skill, knowledge, logical deduction, strategy, or a combination thereof.

In one embodiment, the gaming device includes a game event in which a player aims at a target in attempt to hit that target. In one such embodiment, the game event includes a plurality of targets including at least one target which is designated to be the primary target and one or more secondary targets. In one embodiment, the primary and secondary targets are a sub-set of all the possible targets in the game event. The gaming device displays the plurality of targets to the player and enables the player to input a selection to establish which of the targets will be the primary target for the game event. That is, after the player selects a target, the gaming device designates that player-selected target as the primary target. The gaming device then defines or identifies the secondary targets based on which target is designated as the primary target. Once the player selects the target that is designated as the primary target, the gaming device determines for each of the primary and secondary targets a probability that that target will be hit. The gaming device determines which of the targets is actually hit in the game event based on the probabilities associated with the targets.

The probabilities associated with the primary and secondary targets may be the same or different. In one embodiment, the probability of being hit associated with the primary target is higher than the probability of being hit associated with each of the secondary targets. In another embodiment, the probability of being hit associated with the primary target is higher than the probability of being hit associated with a plurality of the of secondary targets. Thus, in such embodiments, the player's selection of the primary target has a direct impact on which target has the greatest chance of being hit in the game event. In other embodiments, the probability of being hit associated with the primary target is lower than the probability of being hit associated each or a plurality of the secondary targets. In another embodiment, the probability that is associated with a primary or secondary target is based on or changes with respect to the target value.

In one embodiment, the gaming device selects a probability value for each of the targets from a set of discrete probability values. For example, the game includes five targets, and the player selects one of those targets to be the primary target. The gaming device determines that the primary target is associated with a probability of being hit of 50%, and the secondary targets are each associated with a probability of being hit of 12.5%. In this example, the probability of being hit associated with each of the secondary targets is the same. In other embodiments, each or a plurality of the secondary targets may have a different probability of being hit. In various alternative embodiments, the probabilities determined and assigned to the primary and secondary targets are randomly determined, predetermined, determined based on a wager made by the player, or determined according to any other suitable method. In one embodiment, the gaming device uses a distance-based approach to determine the probability of being hit associated with the targets.

Accordingly, the present disclosure enables a player to have a certain level of control over the outcome of the game event and to increase the odds of a favorable outcome in certain implementations of the present disclosure. For example, in one embodiment, the player maximizes the chances of hitting a desired target by selecting that target as the primary target for the game event. The gaming device of the present disclosure also enables the player to participate in the game in a manner that is natural and engaging.

In one example embodiment, the game includes a dart game where the player aims an animated dart at a dartboard and "throws" the dart to try to hit target points on the dartboard. In this embodiment, the gaming machine displays the dartboard to a player. The dartboard includes a plurality of targets. The gaming device enables the player to select one of the targets on the dartboard that the player wants to hit. After the player selects one of the targets, the gaming device designates the player-selected target as the primary target.

In one such embodiment, the gaming device enables the player to select the primary target by moving a target selector or a target area to a desired location on the dartboard. In one embodiment, the target area is an object or image displayed by the display device that can be moved to cover, highlight, or otherwise suitably mark targets on the dartboard. Generally, the player aligns the center of the target area with the primary target. For example, if the target area is circular, the primary target will appear directly beneath the center of the circle.

It should be appreciated that the target area can be of any suitable shape, color, or size. Using target areas of various shapes, sizes, or orientations enables players to select different targets. In one embodiment, the gaming device enables the player to select the target area. For example, the gaming device could offer the player a choice between a circular target area and an oval shaped target area. In another embodiment, the gaming device enables the player to adjust or modify the target area. For example, the player could adjust the target area so that it is wider than it is tall to use a different strategy for selecting targets.

In one embodiment, the gaming device includes a player interface for enabling the player to input his or her selection of the primary target. In one such embodiment, the player interface enables the player to move the target area to various locations on the dartboard to select targets. In one embodiment, the player interface includes a touch screen operable in association with a display device. The touch screen enables the player to aim, steer, or move an item, such as the target area, to selected locations. In another embodiment, the gaming device provides an external input device as the player interface which is mounted on the gaming device.

After the player moves the target area to the desired location on the dartboard and causes the designation of the primary target, the gaming device determines a probability of being hit for each of the primary and secondary targets. In one embodiment, the target area includes only the player's primary target. In such an embodiment, any of the targets that are not included in the target area are designated as secondary targets. In another embodiment, the target area includes the primary target and also includes one or more other targets which are designated as the secondary targets.

After determining the probability of being hit for the primary and secondary targets, the gaming device displays a dart throw and determines which of the targets is hit based on the probabilities. The gaming device provides an award to the player based on the target that is hit.

In one embodiment, the primary target has a higher probability of being hit than each of the secondary targets. In certain embodiments, the probability of being hit associated with the primary target can change for each game event of the game or in a plurality of game events. For example, the gaming device may determine that the selected primary target for a first dart throw has a 50% chance of being hit. In the next dart throw, the gaming device determines that the primary target has a 60% chance of being hit.

In certain embodiments, the gaming device can alter or adjust a player's accuracy of aiming based on the player's wager, based on time, based on skill level, or based on any other suitable method. For example, the gaming device provides the player with a more accurate target area after the player has been playing the game for a certain amount of time or after a certain number of rounds of the game. In another embodiment, different players have different skill levels that affect accuracy of aiming. For example, the gaming device provides a player having a higher skill level with a more accurate target area. In another embodiment, the gaming device enables the player to pay a fee to purchase a more accurate target area. It should be appreciated that the gaming device may adjust a player's accuracy of aiming in any suitable manner.

In one embodiment, the present disclosure is implemented in a multi-player or head-to-head game in which two or more players playing on separate gaming machines play against one another. In one such embodiment, a gaming system includes a central server, central controller, or remote host in communication with or linked to a plurality of gaming machines or gaming devices which form a group. The controller or central server enables one or more players playing at a gaming device in the group to compete in the game.

In certain embodiments, the gaming system includes a common display device to display the games and game outcomes of one or more players, display players' scores or rankings, or to communicate with the players. Thus, each of the players competing in the game can see this information. In other embodiments, the game, game outcomes, and players' scores or rankings are displayed to each of the players on the individual gaming devices. In one such embodiment, players playing against each other in the game are at separate gaming devices, and a player playing at one of the gaming devices can see his or her own play of the game as well as an opponent's play of the game on the display device of that gaming device.

In such embodiments, an individual player's performance in the game is based on a comparison of how that player did in the game versus the other players playing at the gaming devices in the group. In one embodiment, the ranking each player receives in the game is based on that player's performance in the game relative to the other players' performance in the game. In another embodiment, a player's performance is based on a comparison of how the player did in the game versus a predefined set of criteria.

It should be appreciated that the present disclosure may be employed in a primary game, a bonus game, a free spins game, a sub game or in any suitable game.

It is therefore an advantage of the present disclosure to provide a gaming system, gaming machine, and method which includes simulating an activity which normally requires skill in a manner that is natural and engaging.

Another advantage of the present disclosure is to provide a game having an action or event requiring skill, wherein the skill element has a direct impact on the player's chance of obtaining a desired outcome.

Another advantage of the present disclosure is to provide a gaming system, gaming machine, and method that enables players to have a greater amount of influence over the outcome of a game.

A further advantage of the present disclosure is to provides a gaming system, gaming machine, and method that provides a variety of ways in which to tune the accuracy of aiming.

Another advantage of the present disclosure is to provide a gaming system, gaming machine, and method wherein the exact odds of each outcome do not need to be determined in order to provide a fair game. Since all players receive the same information and the same probabilities of success, the game is inherently fair.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
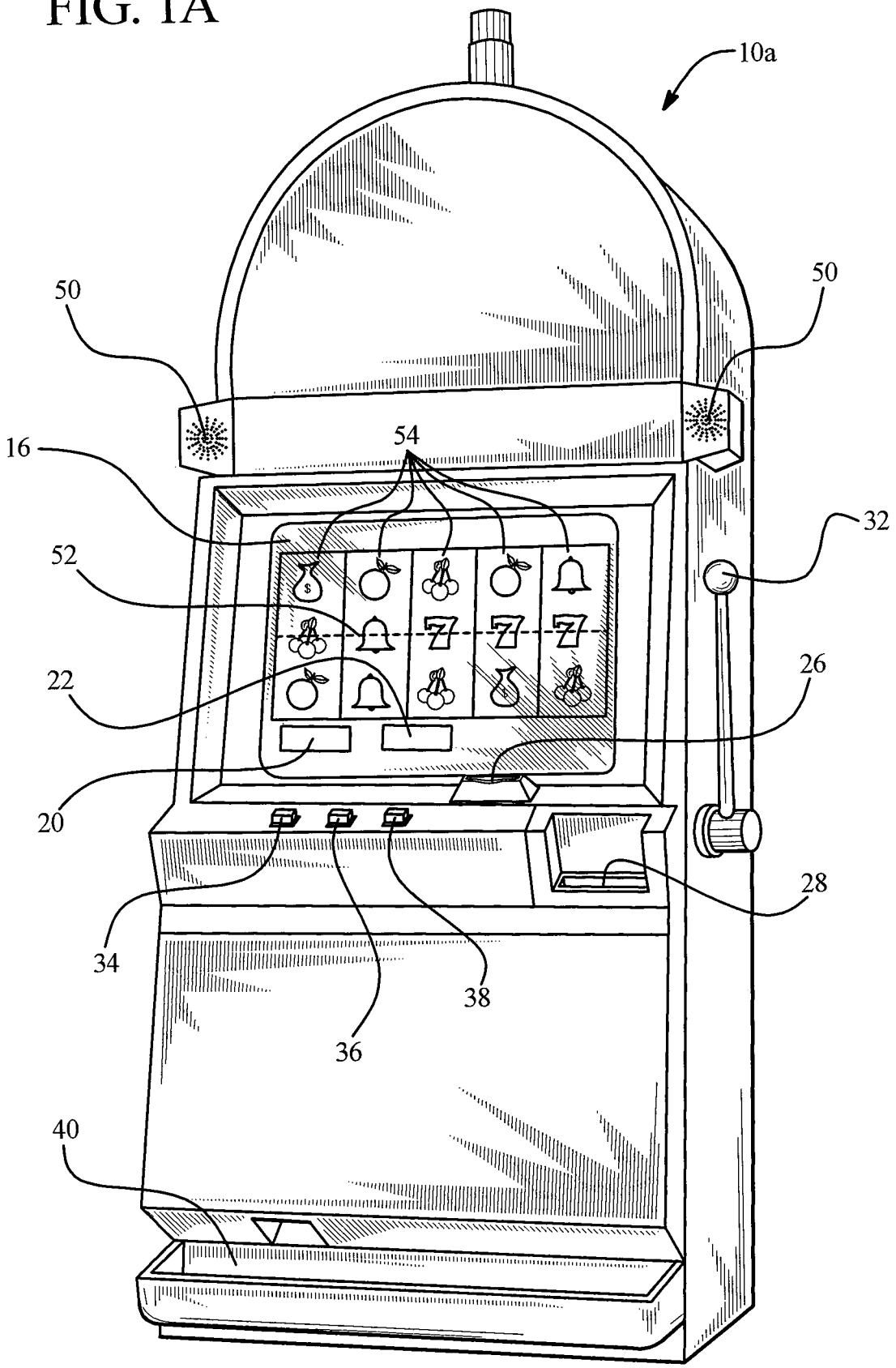
FIG. 1A is a front-side perspective view of one embodiment of the gaming device disclosed herein.
Figure 1B:
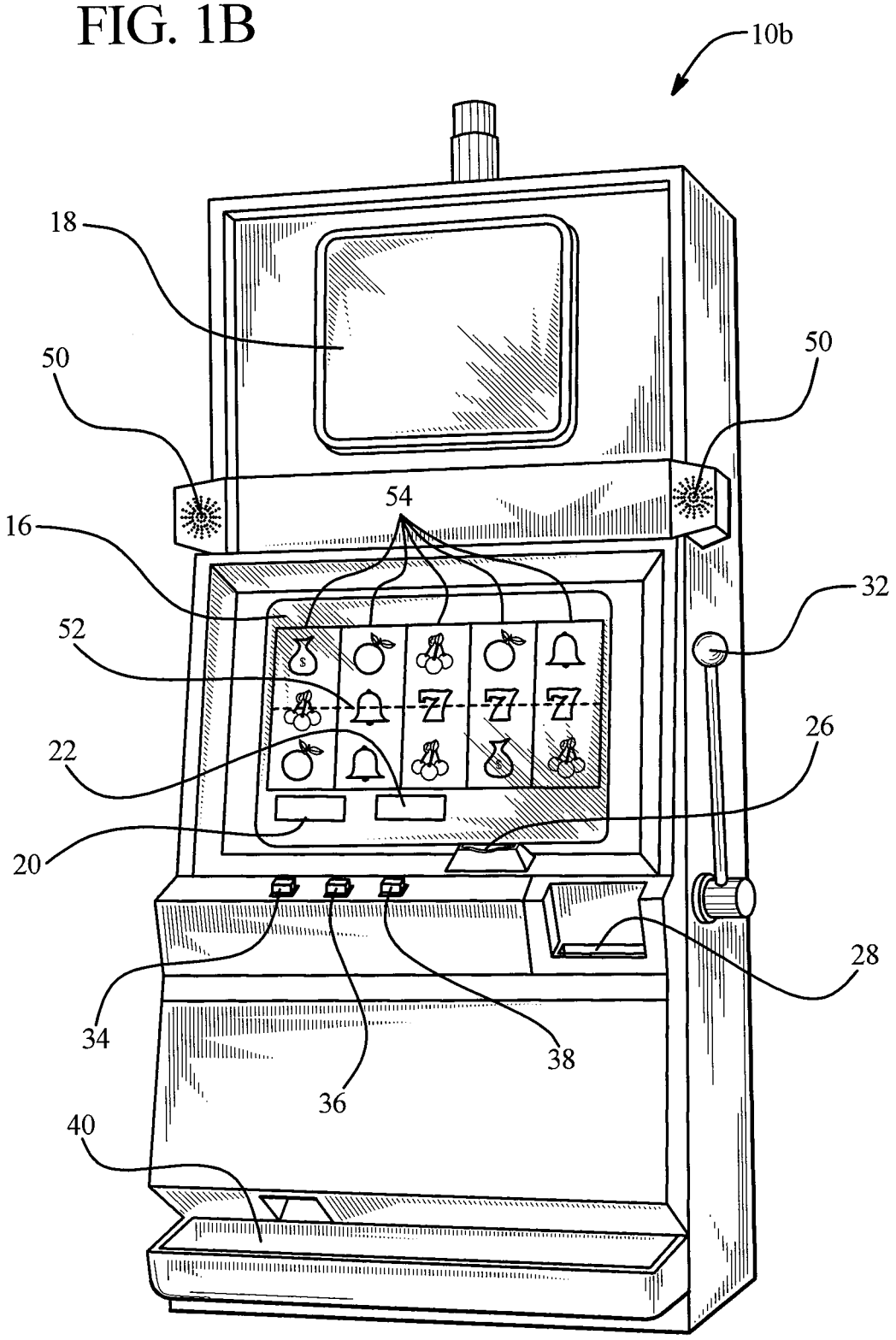
FIG. 1B is a front-side perspective view of another embodiment of the gaming device disclosed herein.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
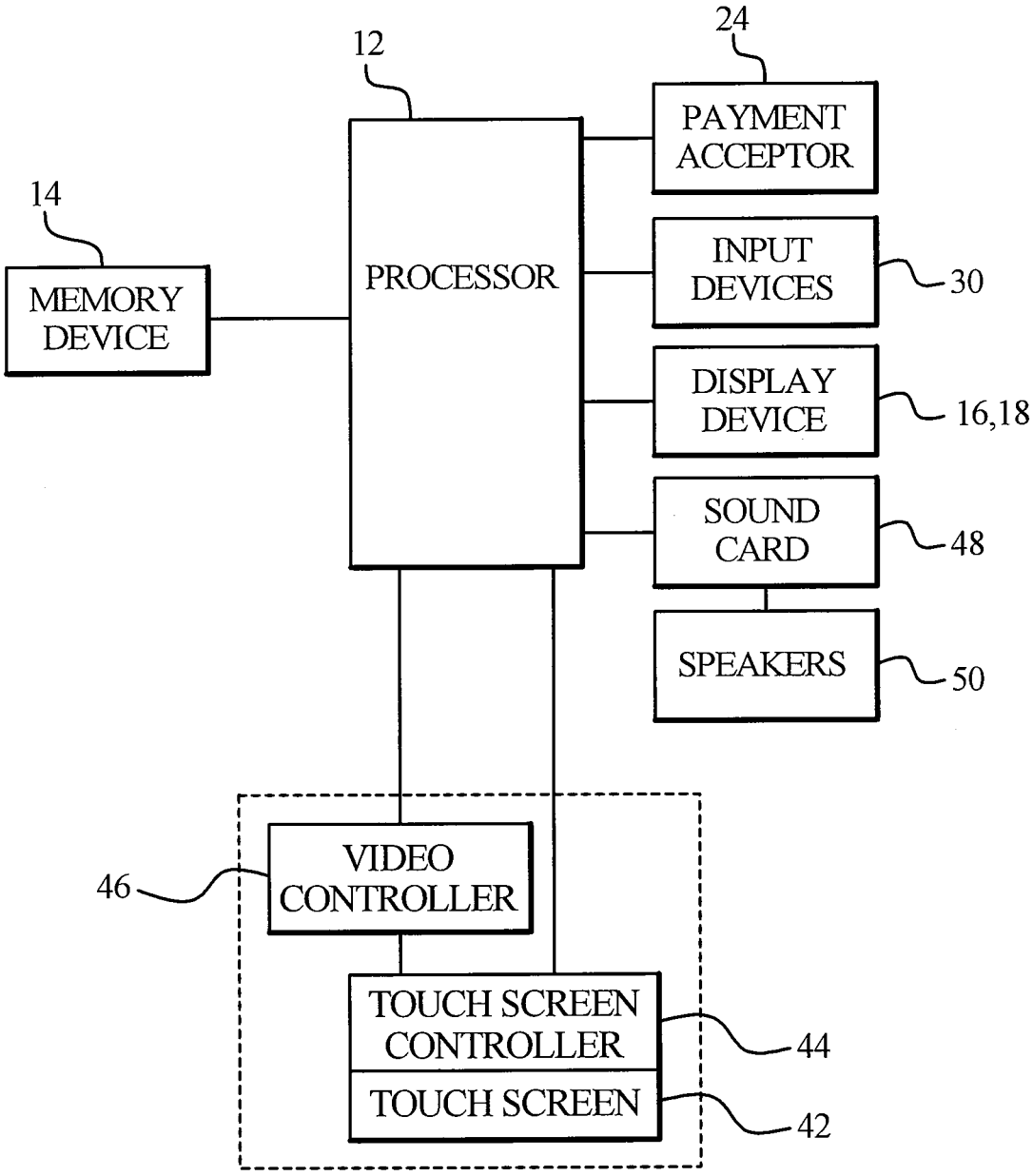
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

In one embodiment, the gaming device includes at least one and preferably a plurality of reels such as three to five reels, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels are in video form, one or more of the display devices, as described above, display the plurality of simulated video reels. Each reel displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

In some embodiments, the ways to win game is applied to a secondary or bonus game, which is played in combination with a base or primary game. If the ways to win game is applied to a bonus game, it operates with one or more base or primary games. In different embodiments in which the ways to win game is a bonus game, different primary wagering games, such as slot games, video poker games, video blackjack games, video keno, video bingo, or any other suitable primary or base game may be implemented. In one embodiment, the base game is provided on the central display device 30, while the bonus game is played on the upper display device 32 (FIG. 1B).

In one such embodiment, if the ways to win game disclosed herein is implemented as a bonus game, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another such embodiment, if the ways to win game is implemented as a bonus game, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In another such embodiment, if the ways to win game is a bonus game, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. In such embodiments, the ways to win game disclosed herein is implemented as a primary or base game. For example, if the ways to win game is a primary game, achieving a certain qualifying condition or triggering event in the primary game triggers a separate bonus game. In some embodiments, if the ways to win game is applied to a base or primary game, the bonus game may be any type of suitable game, either similar to or completely different from the base or primary game.

The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
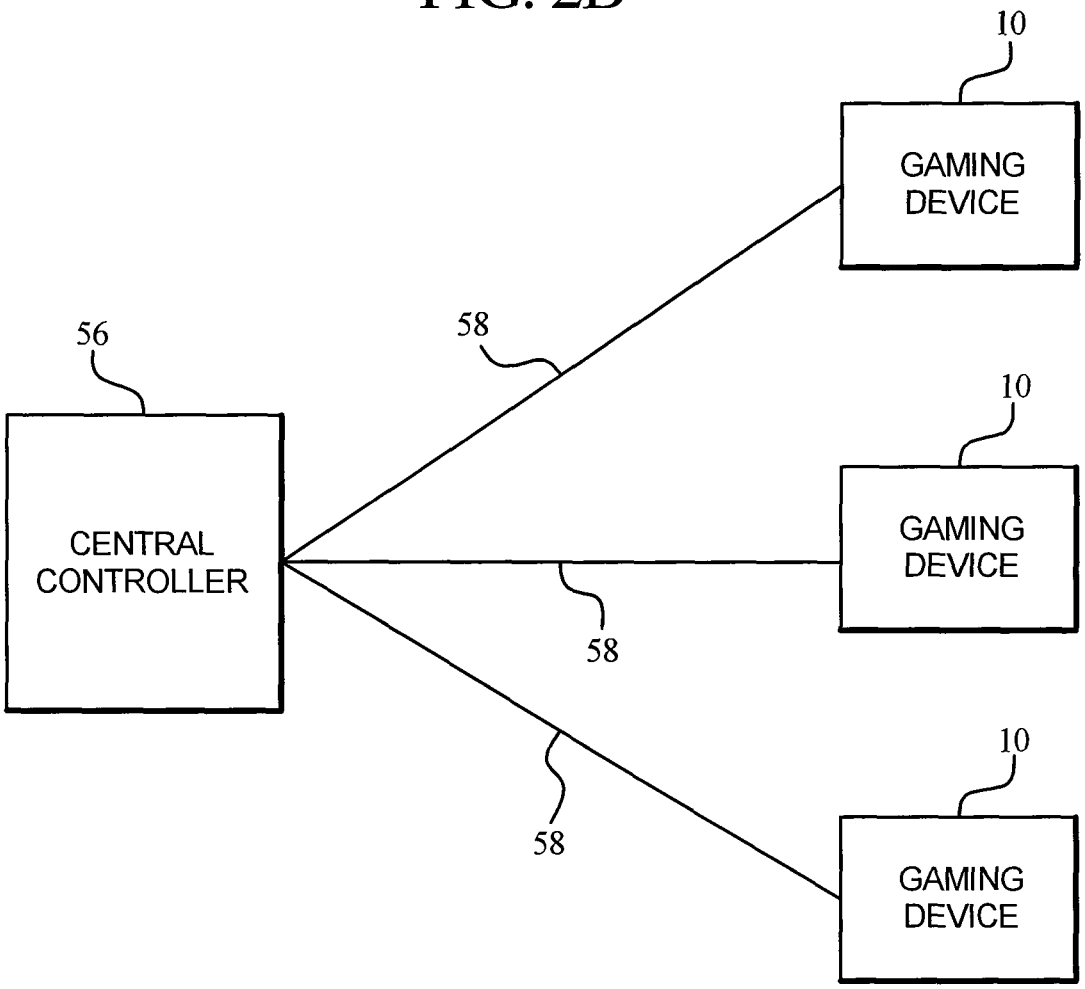
FIG. 2B is a schematic block diagram illustrating a plurality of gaming devices in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Common Gaming Device Components

Figure 3:
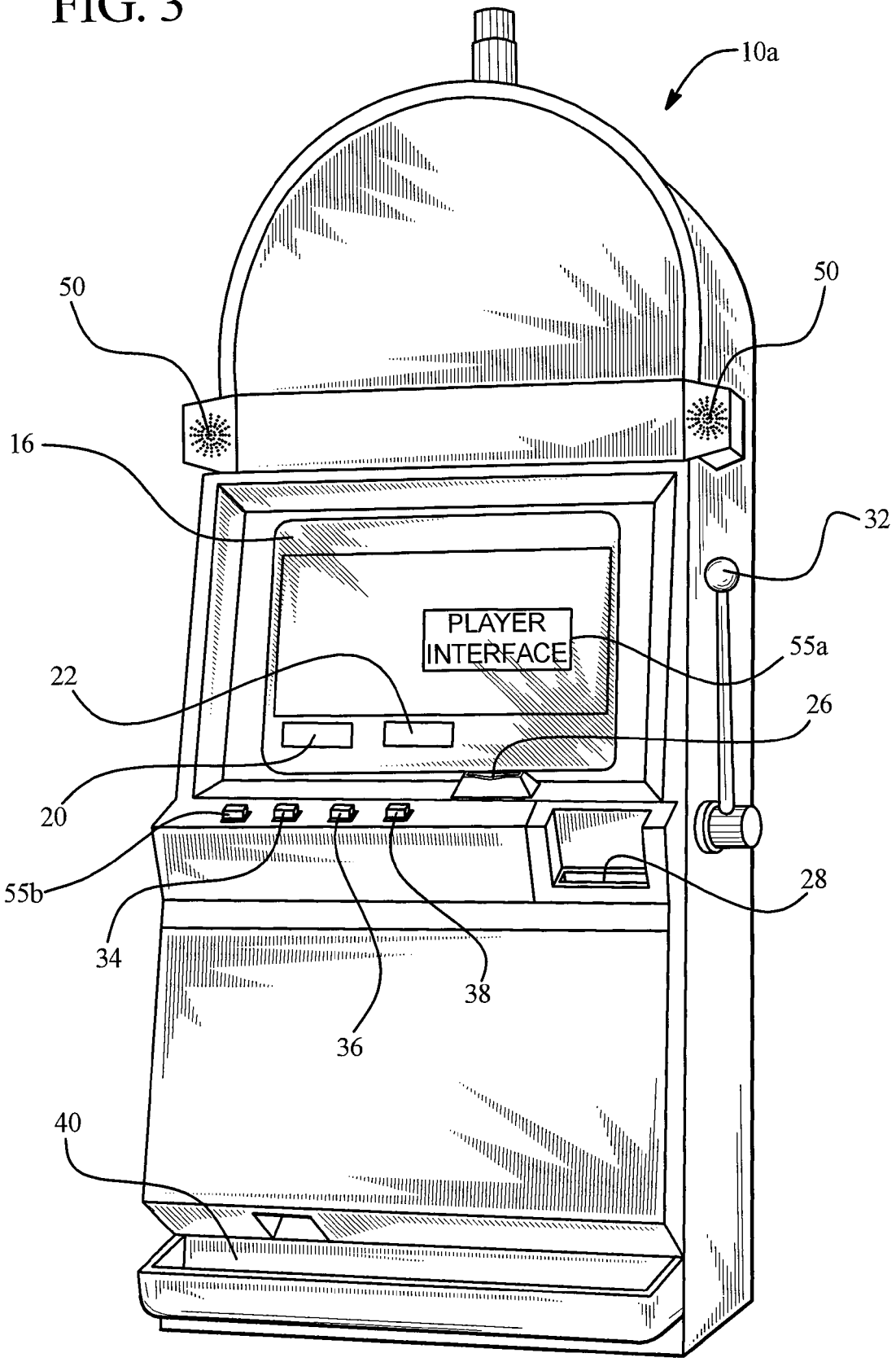
FIG. 3 is a front elevation view of the gaming device illustrating one preferred location and configuration of the player interface of the present invention.

Referring now to FIG. 3, a front elevational view of the gaming device is shown illustrating potential locations of a player interface 55*a* or 55*b*. Each of the embodiments discussed in connection with FIG. 3 is applicable to both gaming devices 10*a* and 10*b*. Each of the embodiments described herein contains a player interface which enables the player to input a selection or decision into the gaming device. The player interface 55*a* or 55*b* can have different configurations depending upon the particular embodiment of the invention. In one embodiment, the player interface 55*a* is a touch screen in association with one of the display devices 16 or 18. The touch screen player interface 55*a* preferably employs digital inputs such as a pushbutton or a plurality of such pushbuttons. The pushbuttons can be configured such that if a player maintains the pushbutton, e.g., presses an arrow for an extended time period, the controller receives a series of digital inputs. The maintainable pushbutton enables the player to steer, direct or aim an item from the touch screen.

In another embodiment, the present disclosure provides an external player interface 55*b*, as shown in FIG. 3. The player interface 55*b* is mounted on the gaming device 10*a* or 10*b* in a suitable location as desired by the implementor. The configuration of the external player interface 55*b* is the same as the touch screen player interface 55*a*, except the external interface employs mechanical devices, while the touch screen interface is simulated.

The external player interface 55*b* preferably employs digital input devices such as a pushbutton or a plurality of such pushbuttons. The present disclosure can also configure the mechanical pushbuttons so that if a player maintains the pushbutton, e.g., presses an arrow for an extended time period, the controller receives a series of digital inputs. The maintainable pushbutton enables the player to steer, direct or aim an item from the gaming device 10*a* or 10*b*. It should be appreciated that the present disclosure can employ other digital or analog external input devices besides pushbuttons, such as toggle switches, joysticks, digitizers or wheels etc.

Player Controlled Targeting

Figure 4:
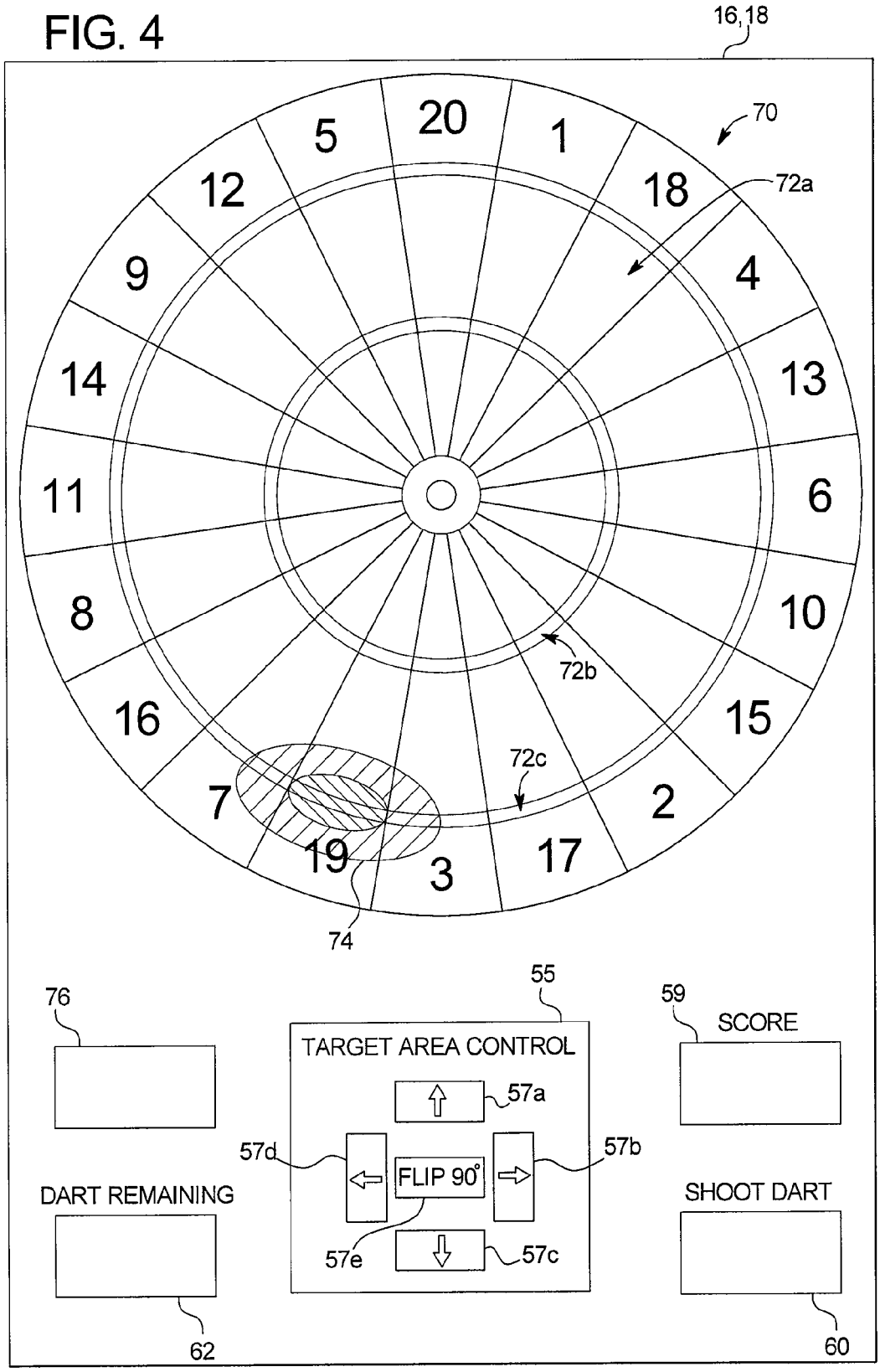
FIG. 4 is an enlarged front plan view illustrating the display device of a gaming devices during play of the game.

Referring now to FIG. 4, an enlarged view of one of the display devices 16 or 18 shows one example embodiment of the present disclosure which provides a game including a game event that mimics an action or event requiring skill. In the illustrated embodiment, the gaming device includes a game in which a player aims at a target. It should be appreciated that the game of the present disclosure can involve any suitable type of game event that mimics a skill event, such as: (i) moving an object to a correct or desired location; (ii) aiming an object; (iii) steering an object out of the way of oncoming objects or steering a moving object so that it does not hit objects in its path; (iv) choosing between paths; (v) choosing a desired or undesired outcome; or (vi) any combination of these.

In the example of FIG. 4, the game event includes a dart throw in a dart game. FIG. 4 illustrates a screen shot on the display device 16 of gaming device 10. The screen shot displays a dartboard 70, which is divided into a plurality of wedges. Dartboard 70 of FIG. 4 includes twenty wedges. It should be appreciated that dartboard 70 can include any suitable number of wedges, can have a multitude of shapes, and is not limited to being circular as illustrated in FIG. 4.

In a play of the game, in one embodiment, the gaming device enables the player to select one of the targets (e.g., the 18 target (or "single 18" target) 72*a*, the "triple 2" target 72*b*, and the "double 17" target 72*c*) on the wedges of the dartboard 70. In certain alternative embodiments, the gaming device enables the player to select more than one target. After the player selects a target, the gaming device designates the player-selected target as the primary target. In one embodiment, the gaming device enables the player to select the target that is designated as the primary target by moving a target area 74 to the location of the primary target.

In this example, the target area 74 is an image on the display that can traverse the dartboard. In this example, the gaming device enables the player to move the target area 74 to different locations on the dartboard and stop over the target that the player wishes to designate as the primary target.

As illustrated in FIG. 4, the gaming device 10 includes an interface or a target control area 55 which enables the player to move the target area 74 on the dartboard 70. The target control area 55 includes a plurality of pushbuttons 57*a*, 57*b*, 57*c*, 57*d*, and 57*e* for enabling the player to input directions or other instructions, such as up, down, left, right, and flip 90 degrees.

Generally, to select a target, the player aligns the center of the target area 74 with the primary target. For example, if the target area 74 is oval-shaped, the primary target appears directly beneath the center of the oval. In one embodiment, the target area 74 is sufficiently transparent or translucent to enable the user to identify the bounds of the targets such that the player can see which target or targets are covered by or included in the target area. As seen in FIG. 4, the player selects the "Double 19" target as the primary target. That is, the player has moved the target area 74 such that the double 19 target on dartboard 70 is aligned with the center of the target area 74.

In one embodiment, the target area 74 includes only the primary target. Thus, any of the available targets on the dartboard 70 that are not in the target area 74 are designated as secondary targets. In another embodiment, the target area 74 includes at least the primary target and one or more other targets which are designated as the secondary targets. For example, in FIG. 4, the target area 74 is centered over the double 19 target, but also includes or partially includes other targets, such as the 7, double 7, 19, 3, and double 3 targets. In this example, the other targets in the target area 74 are designated as secondary targets.

In some embodiments, the gaming device enables the player to adjust one or more settings or characteristics of the target area 74. For example, in a game employing an oval-shaped target area 74, the gaming device could enable the player to set the target area 74 such that the oval must be perpendicular to the primary target. Alternatively, the player could adjust the properties of the target area 74 such that the oval must be parallel to the primary target. Adjusting the target area 74 in this manner enables the player to manipulate which targets or how many targets are covered by the target area 74.

In certain embodiments, the player can use different target areas to select different targets. In one embodiment, the gaming device enables the player to select the target area 74. In one such embodiment, the gaming device offers the player a choice between a plurality of different target areas. For example, the gaming device could enable the player to choose a target area from a group of target areas having various shapes, sizes, or orientations. In another embodiment, the gaming device enables the player to adjust or modify the target area 74. For example, the player could adjust the target area 74 so that it is wider than it is tall to use a different strategy for selecting targets.

After the player-selected target is designated as the primary target and the secondary targets are identified, the gaming device 10 determines a probability of being hit for each of the primary and secondary targets. In one embodiment, the probability of being hit associated with the primary target is higher than the probability of being hit associated with each of the secondary targets. In another embodiment, the probability of being hit associated with the primary target is higher than the probability of being hit associated with a plurality of the of secondary targets. In other embodiments, the probability of being hit associated with the primary target is lower than the probabilities of being hit associated with each or a plurality of the secondary targets.

In one embodiment, the gaming device selects a probability value for each of the targets from a set of discrete probability values. For example, in the gaming device determines that the double 19 target on dartboard 70 of FIG. 4 is associated with a probability of being hit of 30%, and each of the five secondary targets (i.e., the 7, double 7, 19, 3, and double 3) are associated with a 14% probability of being hit. The player's selection of the primary target has a direct impact on which target has the greatest chance of being hit. In the example of FIG. 4, the chances that a double 19 will be hit are maximized. The target area 74 helps depict the odds that the dart will land in a particular location.

In various alternative embodiments, the probabilities determined and assigned to the primary and secondary targets are randomly determined, predetermined, determined based on a wager made by the player, or determined according to any other suitable method. In one embodiment, the probability of being hit associated with a target is related to value of the target. For example, a target having a higher value may be associated with a probability of being hit that is lower than a target having a lower value.

In one embodiment, the probabilities associated with the targets are tailored to the type of game event in which the player is participating. Thus, game events may be simulated in a more realistic manner. For example, a primary target in a dart game may be associated with a lower probability of being hit than a primary target in a game where the player is throwing a grenade in attempt to hit that primary target. It should be appreciated, however, that in such embodiments, the actual outcome of the game event is still a random determination. That is, the actual outcome of the game event, such as throwing the dart or throwing the grenade, is based on the probabilities associated with the targets.

In one embodiment, the gaming device includes different probability ranges for hitting the primary target for different types of events. For example, in a dart game, a player may have a 10 to 30% chance of hitting the selected primary target. In a grenade throwing game, the player may have a 30 to 50% chance of hitting the selected primary target.

In one embodiment, the gaming device associates different groups of targets with certain probabilities of being hit. In one example involving a dart game, the targets that provide triple points are associated with a first probability of being hit, and the targets that provide single points are associated with a second different probability of being hit. In this embodiment, the first probability associated with the triple targets is lower than the second probability associated with the single targets. Thus, the game more closely resembles a real game of darts because the triple targets are harder to hit.

In one alternative embodiment, the gaming device uses a distance-based approach to determine the probability of being hit associated with the targets. In this embodiment, the distance from the selected target determines the probability of hitting that target.

Accordingly, the present disclosure enables a player to increase the odds of a favorable outcome. The player improves his or her chances of hitting a certain target by selecting that target as the primary target.

Referring now generally to FIGS. 5A to 5I, in another embodiment of the present disclosure, a gaming system enables a plurality of players to play against each other in the game involving skill. In this embodiment, a gaming system includes a central server or controller 56 and a plurality of gaming machines or gaming devices. The gaming system may include any suitable number of gaming machines in communication with or linked to the central server or controller 56. These gaming machines may be referred to herein alternatively as the gaming machines, the gaming stations or the linked gaming machines. The gaming machines may be the same type or different types of gaming machines.

The play of each of the gaming machines in the group is monitored by the central server 56. The central server or controller may be any suitable server or computing device which includes a processor and a memory or storage device. In alternative embodiments, the central server is a progressive controller or another gaming machine in the gaming system.

Each gaming machine in the group includes a display device operable to display the game in which each player participates. In this multiple gaming machine embodiment, the same game, such as the same dart game, is provided to two or more or each player. In one embodiment, the gaming system includes a common display device to display the games and game outcomes of one or more players, to display the players' scores or rankings, or to communicate with the players. In other embodiments, the game, game outcomes, and players' scores or rankings are displayed to each of the players on the individual gaming devices. In one embodiment, each player can see his or her own play of the game as well as any opponents' plays of the game on the display device.

Figure 5A:
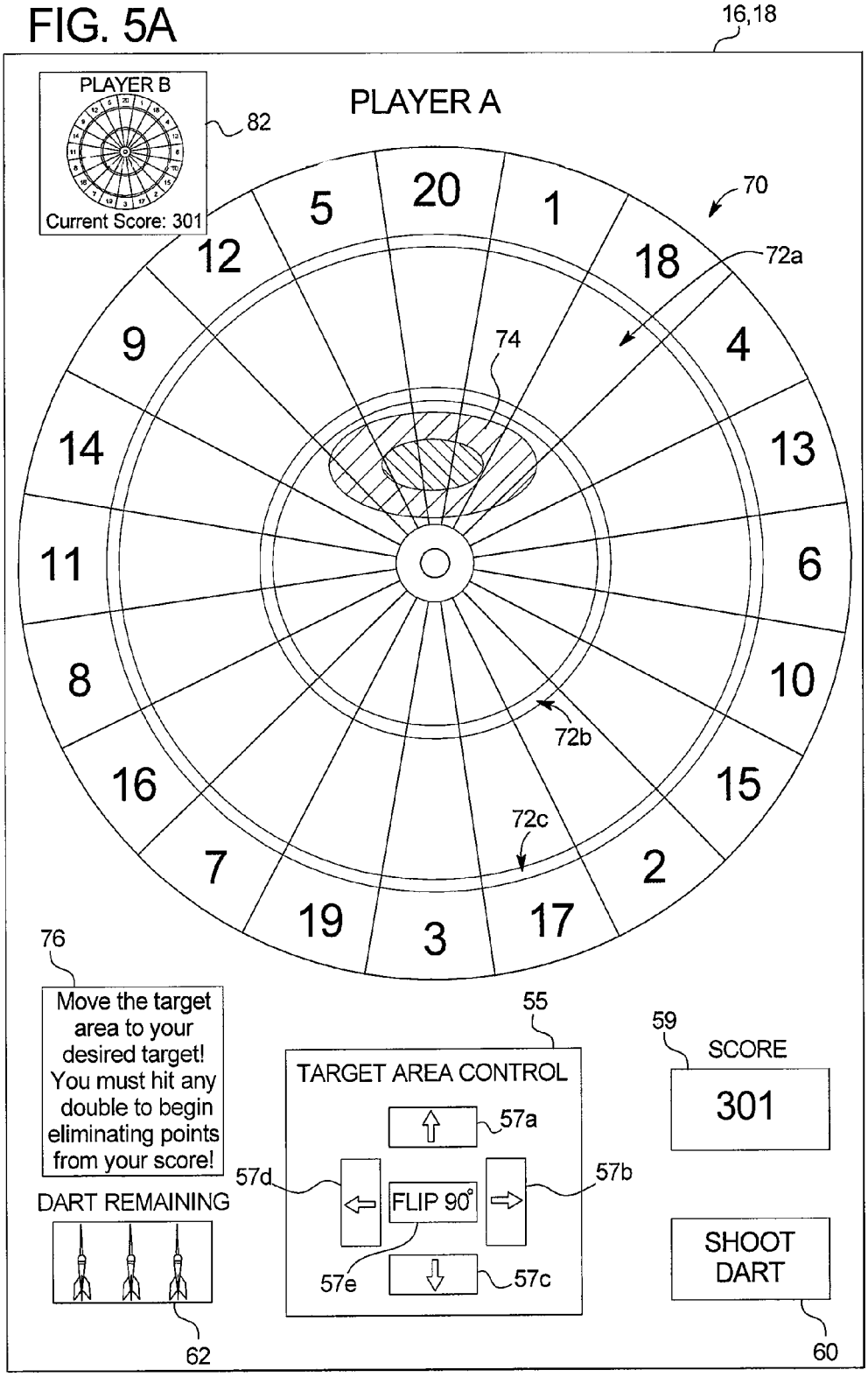
FIGS. 5A, 5B, 5C, 5D, 5E, 5F, 5G, 5H, and 5I illustrate one example embodiment of the present disclosure implemented in a head-to-head dart game.

FIG. 5A illustrates the display device 16 of a first player playing the game at a gaming device that is in the gaming system (i.e., Player A). In this example, the game is a common dart game known as "301 Darts." In 301 Darts, each participating player begins with a score of 301 points. The objective of the game is to get down to a score of exactly zero. For example, if a player throws a dart which lands on the triple 20 location of the dartboard, 60 points are subtracted from the player's score. To begin eliminating points from the score, a player must throw a dart and hit a double, such as the "Double 20" location (or target) on the dartboard. Once a player hits a double, subsequent dart throws by that player may result in points subtracted from the player's score. Each player has three dart throws in a turn. The players alternate taking turns, and the first player to achieve a score of zero wins the game.

In one embodiment, the gaming device requires a player to wager a minimum amount, such as five dollars, to initiate the game. In another embodiment, the gaming device enables a player to place a wager for the game in a conventional slot or other wagering gaming device format. After the wager is made, the gaming device displays and initiates the game.

In one embodiment, the game of the present disclosure is implemented in a player competition or player vs. player gaming environment. In one such embodiment, a player at a gaming device 10 plays the game against at least one other player playing at a different gaming device. In this example, Player A is playing against Player B.

FIG. 5A illustrates the screen that Player A sees at his or her gaming device at the beginning of Player A's first turn. As seen in FIG. 5A, the gaming device 10 displays a dartboard 70 having a plurality of targets (e.g., the 18 target (or "single 18" target) 72*a*, the "triple 2" target 72*b*, and the "double 17" target 72*c*) to. Player A. The gaming device includes a score display 59 which indicates that Player A has a current score of 301 in the game. The gaming device also includes a darts remaining display 62. The dart remaining display 62 includes 3 darts, indicating that Player A has not thrown any darts in this turn. The gaming device further includes a target control area 55 which enables a player to aim the dart. The target control area includes a plurality of pushbuttons 57*a*, 57*b*, 57*c*, 57*d*, and 57*e* for enabling a player to input directions for positioning the target area 74.

The gaming device also includes a display window 82 to show Player A the opponent's dartboard and current score in the game. As indicated by display window 82, Player B has not thrown any darts in the game, and thus the dartboard in the display window 82 is blank (i.e., has no darts on it) and Player B's current score is 301.

The display device 16 or 18 displays an audio, visual, or audiovisual message 76 prompting Player A to move the target area to a desired target. The gaming device 10 enables Player A to position the target area on the dartboard 70 by using the pushbuttons 57*a*, 57*b*, 57*c*, 57*d*, and 57*e* shown on display device 16. The gaming device 10 moves or adjusts the target area according to Player A's input.

Figure 5B:
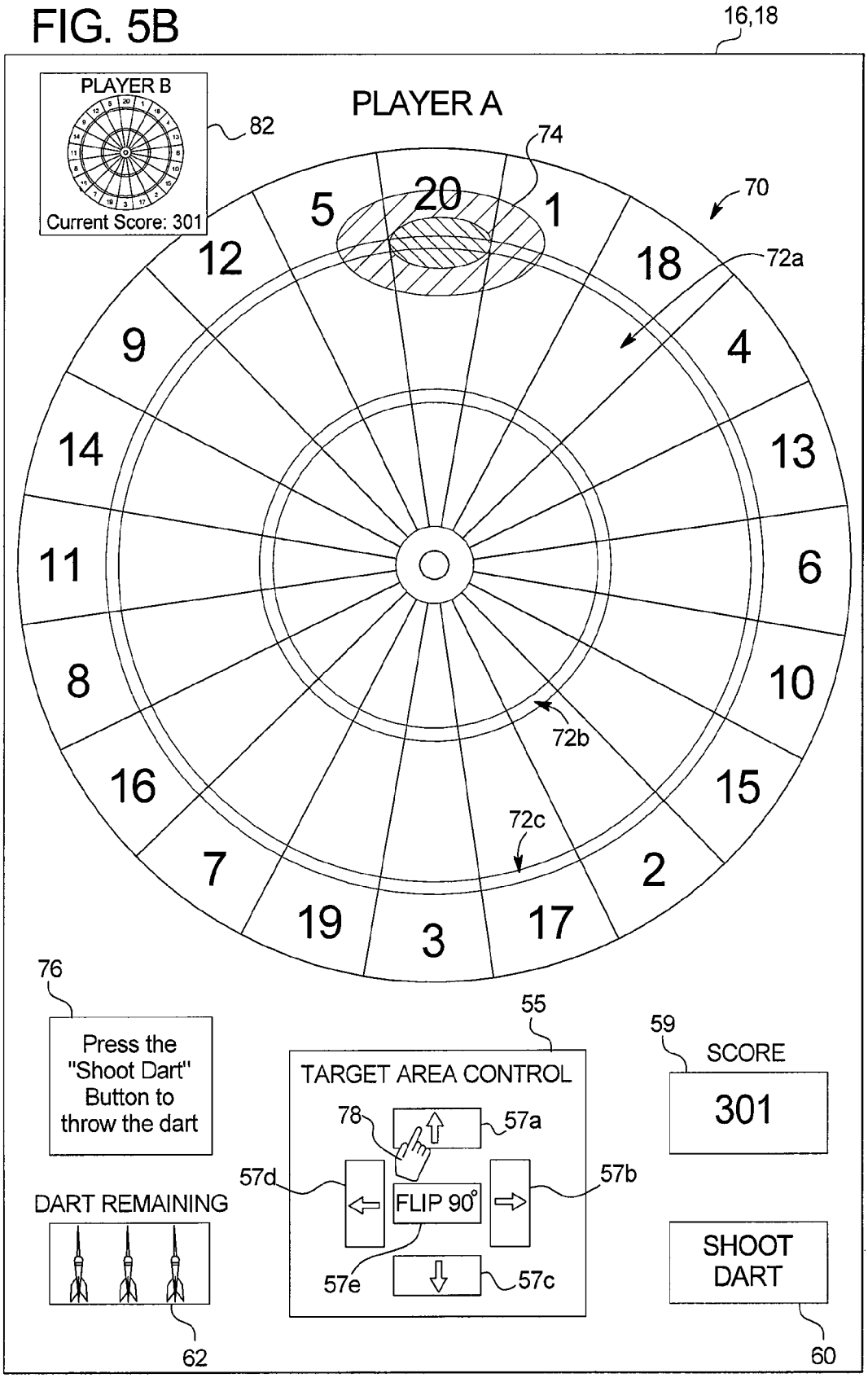

As illustrated in FIG. 5B, Player A 78 pushes pushbutton 57*a* to move the target area in an upward direction until the center of the target area 74 is aligned with the double 20. The double 20 is therefore the primary target, and the other targets which are covered or partially covered by the target area are the secondary targets. In this example, there are five secondary targets including the 5, double 5, 20, 1, and double 1.

After Player A selects the primary target, the gaming device determines the probability that the primary and secondary targets will be hit. In one embodiment, the primary target has the highest probability of being hit. For example, the gaming device determines that the primary target (i.e., the double 20) will have an 80% chance of being hit in the first dart throw, and each of the secondary targets has a 4% chance of being hit.

It should be appreciated that selecting the double 20 as the primary target for the first dart is a strategic decision by Player A. As described above, in the 301 darts game, each player must hit a double before points can be eliminated from the player's score.

Figure 5C:
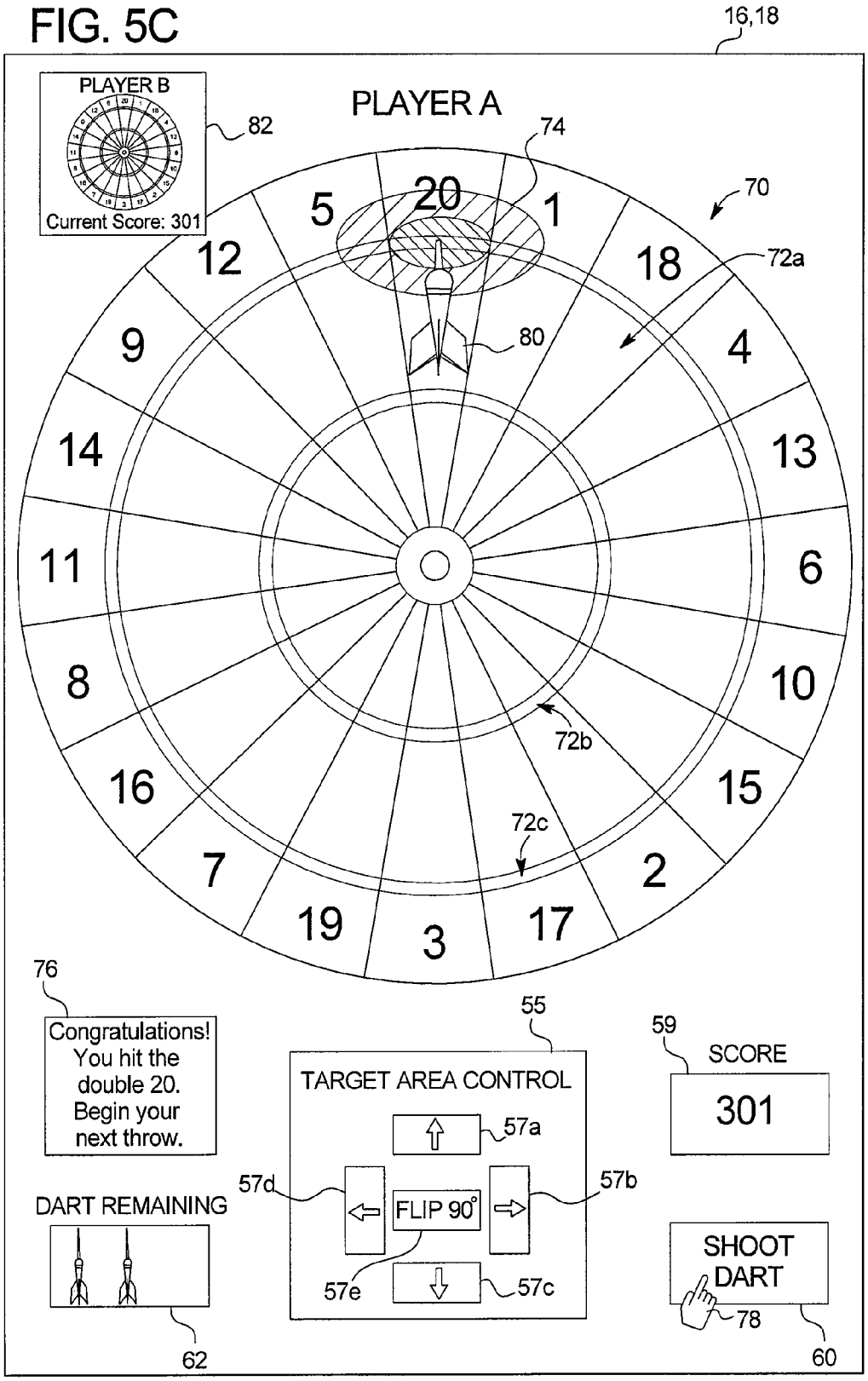

In FIG. 5C, Player A 78 pushes the shoot dart button 60 to throw the first dart, and the gaming device 10 displays the first dart throw 80 of Player A's first turn. The dart throw 80 results in a hit. The dart throw 80 hit the double 20 on dartboard 70. No points are subtracted from Player A's score, as indicated by the score display 59, because this was the first dart throw to hit a double. However, each of Player A's subsequent dart throws may contribute to eliminating points from the score.

Figure 5D:
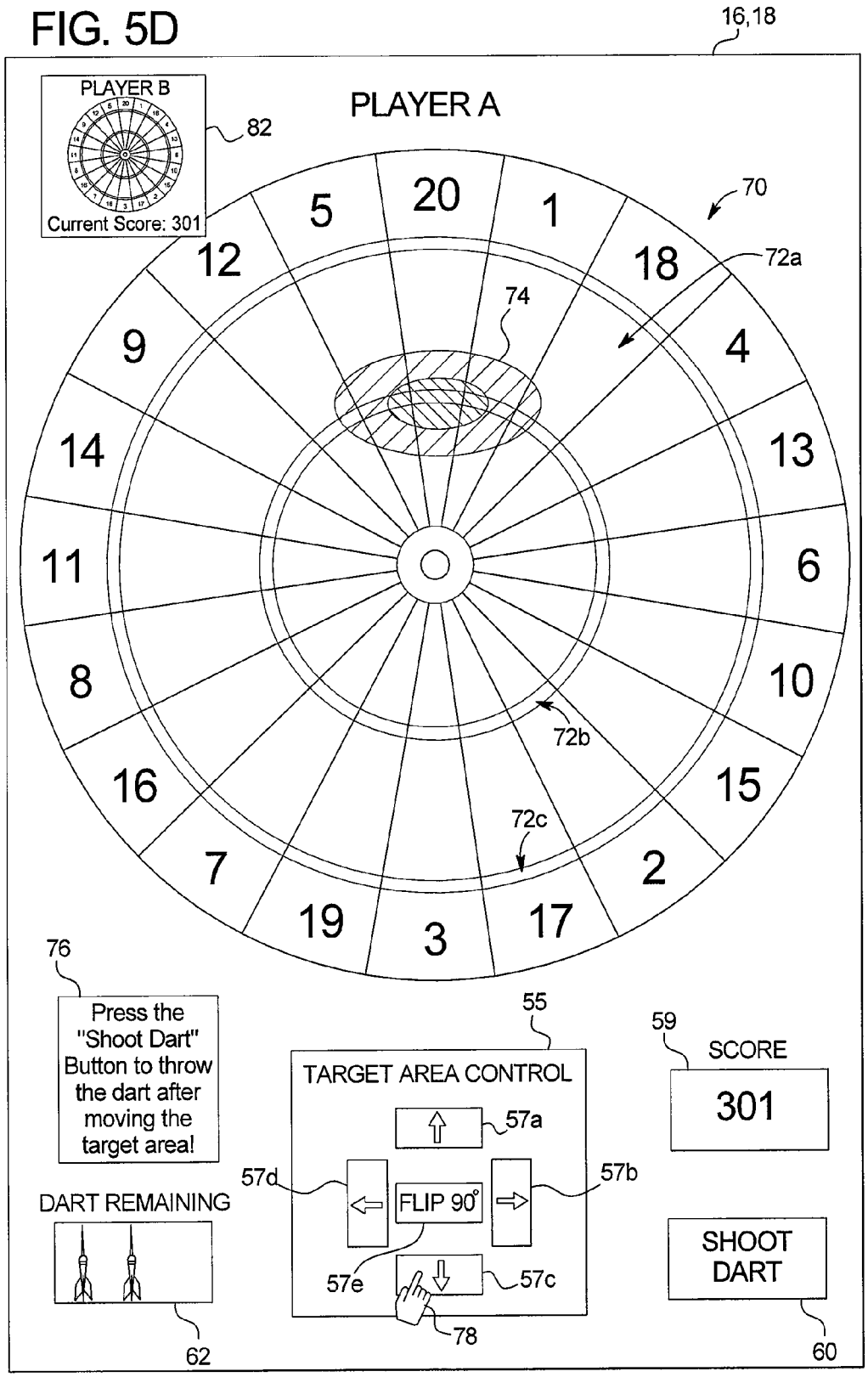

As illustrated in FIG. 5D, the darts remaining display 62 indicates that Player A has two darts remaining in this turn. The display device 16 or 18 displays an audio, visual, or audiovisual message 76 prompting Player A to move the target area 74 to a desired target and then press the shoot dart button 60 to throw the dart. In FIG. 5D, Player A 78 pushes pushbutton 57*c* to move the target area 74 down such that the center of the target area 74 is aligned with the triple 20.

In certain embodiments, in addition to enabling a player to move or steer the target area to a desired location, the gaming device enables the player to change or modify the target area used to select targets. In one embodiment, the gaming device enables the player to use target areas of various shapes to select different targets. For example, the player could use a target area that is wider than it is tall in order to use a different strategy for selecting targets.

Figure 5E:
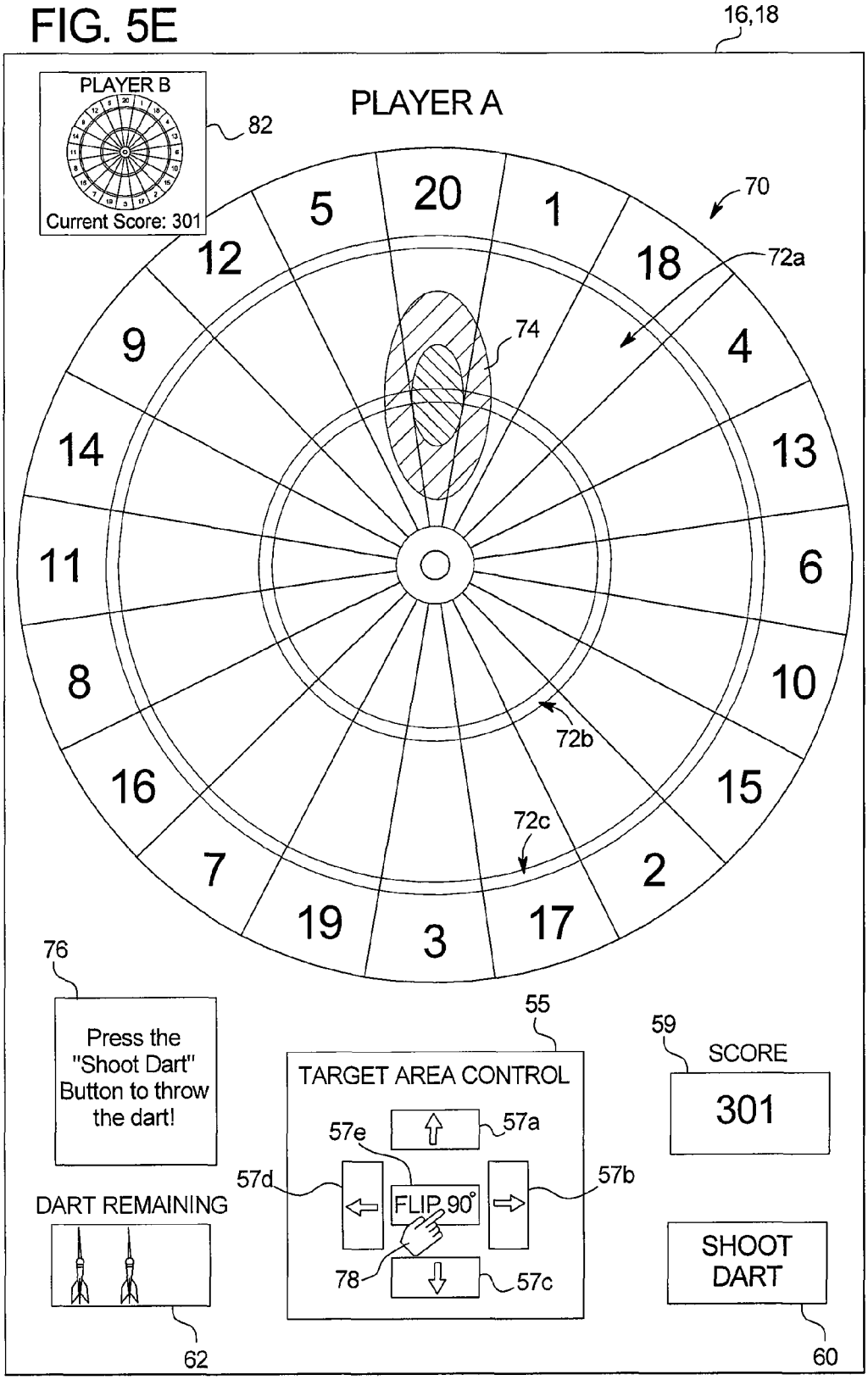

As seen in FIG. 5E, Player A 78 pushes the pushbutton 57*e* to flip the target area 74 by 90 degrees. The gaming device 10 then rotates the target area so that instead of having a horizontally elongated oval shape, the target area has a vertically elongated oval shape. The center of the target area 74 is still aligned with the triple 20, which is the primary target.

The gaming device determines the probability that the primary and secondary targets will be hit. For example, the gaming device determines that the primary target (i.e., the triple 20) will have an 50% chance of being hit in the first dart throw, and each of the secondary targets (i.e., 20, triple 5, 5, triple 1, and 1) has a 10% chance of being hit. Accordingly, Player A strategically adjusted the target area to maximize the chance that a 20 will be hit.

In various alternative embodiments, the gaming device can alter or adjust a player's accuracy of aiming based on the player's wager, based on time, based on skill level, or based on any combination of these. For example, the gaming device provides the player with a more accurate target area after the player has been playing the game for a certain amount of time or after a certain number of turns in the game. In one embodiment, gaming device is scaled so that a wager of one credit buys a target area with a certain level of accuracy and a higher wager buys a target area with a higher level of accuracy. For example, one credit could buy a 50% chance of hitting the primary target in the target area, while each additional credit would buy an additional 10% chance of hitting the primary target in the target area. Thus, the player wagering more can win more. In another embodiment, players having different skill levels will have different accuracy of aiming. For example, a player having a higher skill level has a more accurate target area. The gaming device may adjust a player's accuracy of aiming in any suitable method.

Figure 5F:
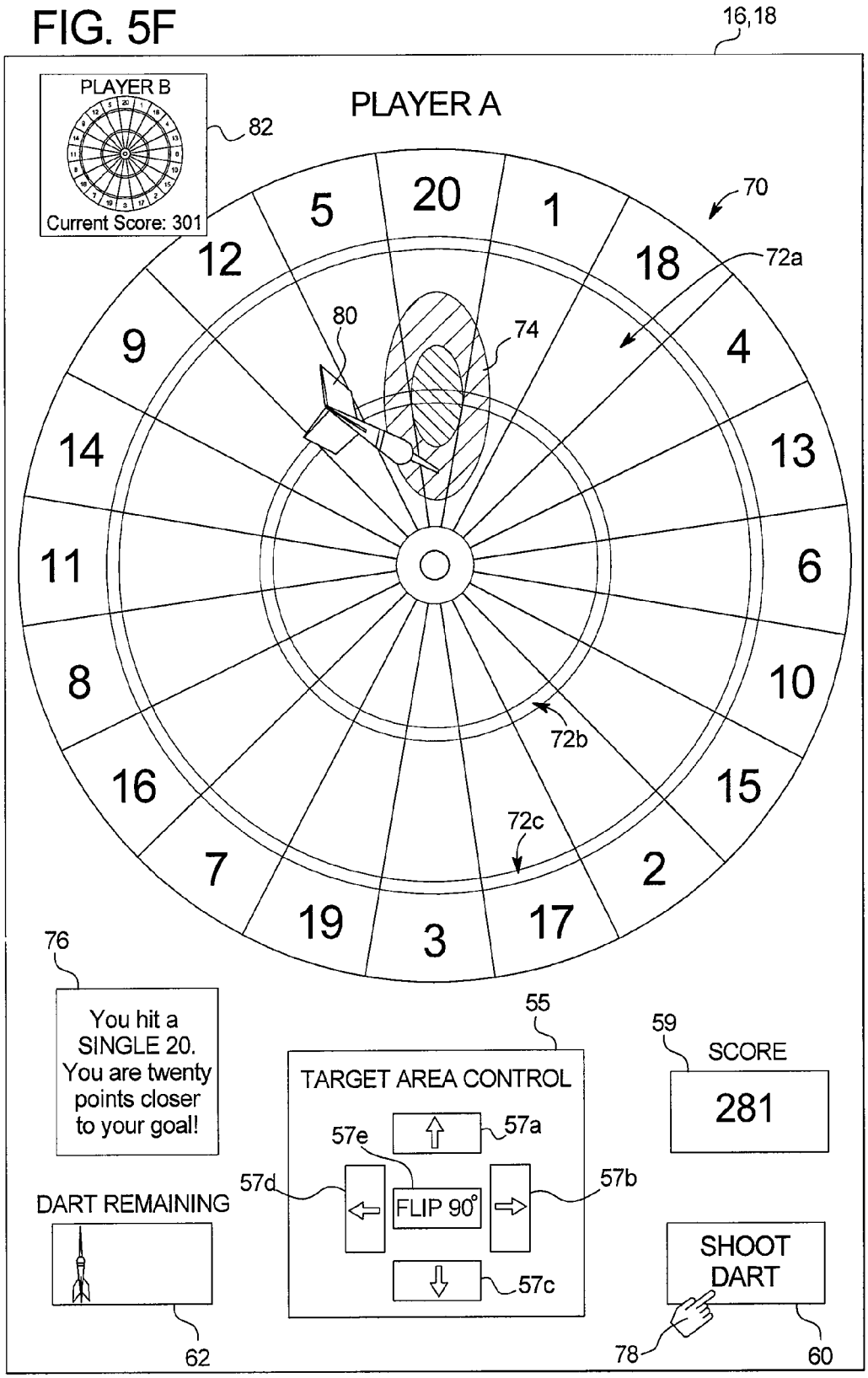

As illustrated in FIG. 5F, Player A 78 pushes the shoot dart button 60, and the gaming device 10 displays the second dart throw 80 in Player A's first turn. The second dart throw 80 results in a hit. The dart throw 80 hit the single 20 target on dartboard 70.

Thus, the gaming device 10 subtracts twenty points from Player A score of 301, and the score display 60 indicates a score of 281. The darts remaining display 62 shows that Player A has one dart remaining in this turn.

Figure 5G:
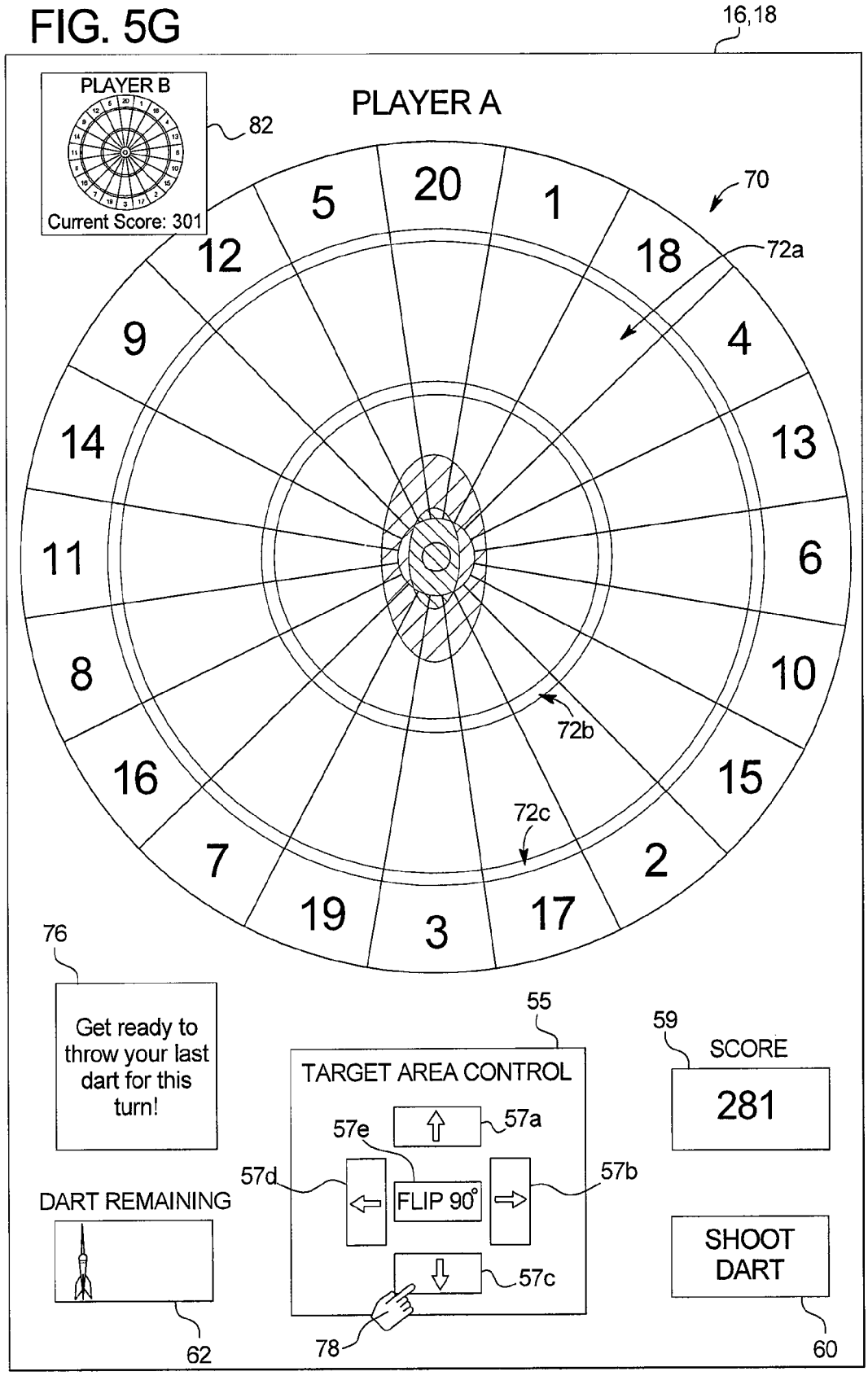

As illustrated in FIG. 5G, the display device 16 or 18 displays an audio, visual, or audiovisual message 76 prompting Player A to throw the final dart for this turn. Player A 78 pushes the pushbutton 57*c* to move the target area 74 down such that the center of the target area 74 is aligned with the double bulls-eye. Player A has selected the double bulls-eye as the primary target.

The gaming device determines the probability that the primary and secondary targets will be hit. For example, the gaming device determines that the double bulls-eye will have a 75% chance of being hit in the third dart throw, and each of the secondary targets (i.e., targets 1 to 20 and the bulls-eye) will have a 1.19% chance of being hit.

Choosing the bulls-eye is a good strategy for Player A at this point in the game. In this example, the bulls-eye is associated with twenty five points. Thus, hitting the double bulls-eye would enable Player A to eliminate 50 points from Player A's score.

Figure 5H:
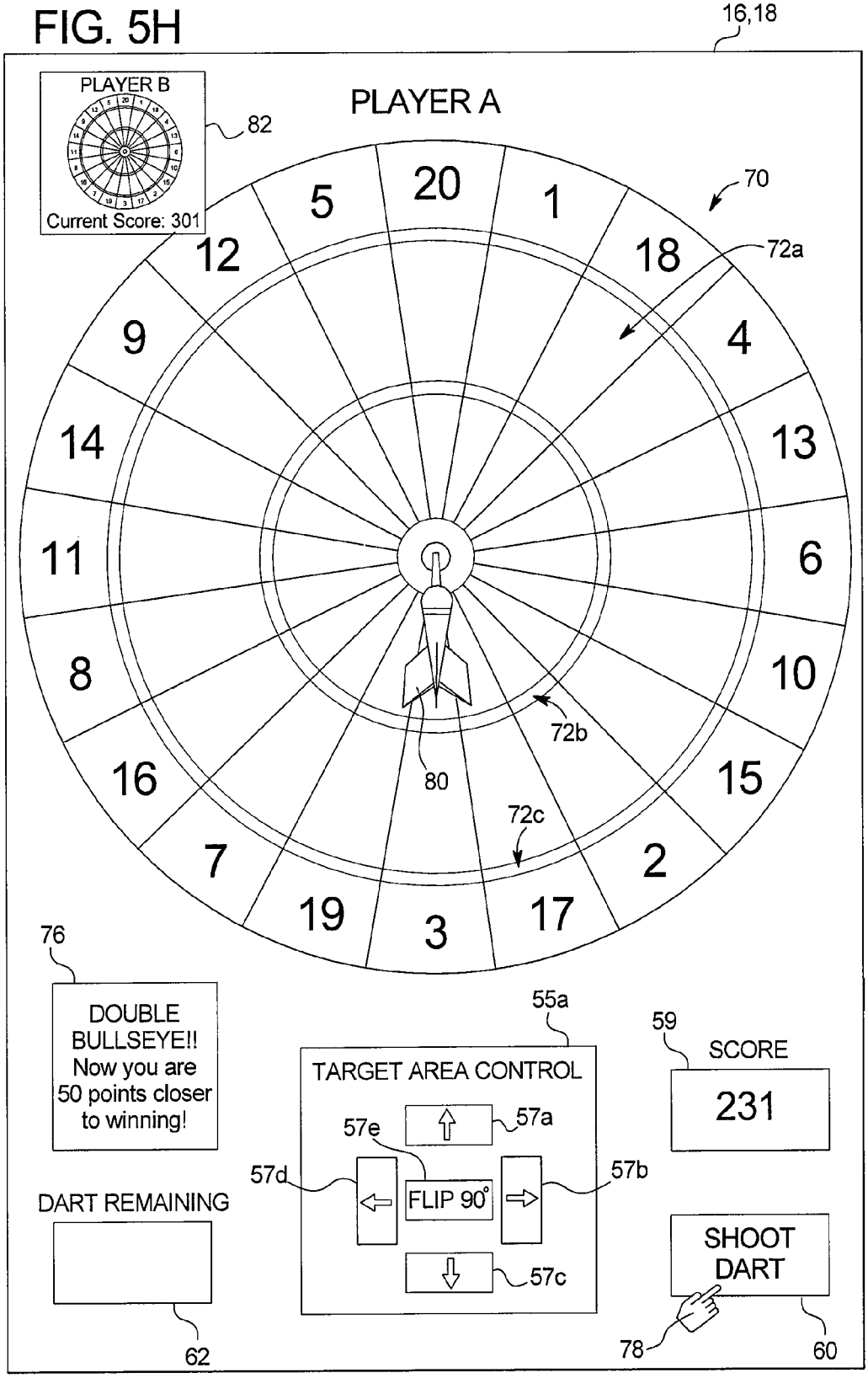

As illustrated in FIG. 5H, Player A 78 pushes the shoot dart button 60, and the gaming device 10 displays the third dart throw 80 in Player A's first turn. The third dart throw 80 results in a hit. The dart throw 80 hit the double bulls-eye. Thus, the gaming device 10 subtracts fifty points from Player A's score of 281, and the and the score display 60 indicates a score of 231. The darts remaining display 62 shows no darts, indicating that Player A's turn has ended.

Figure 5I:
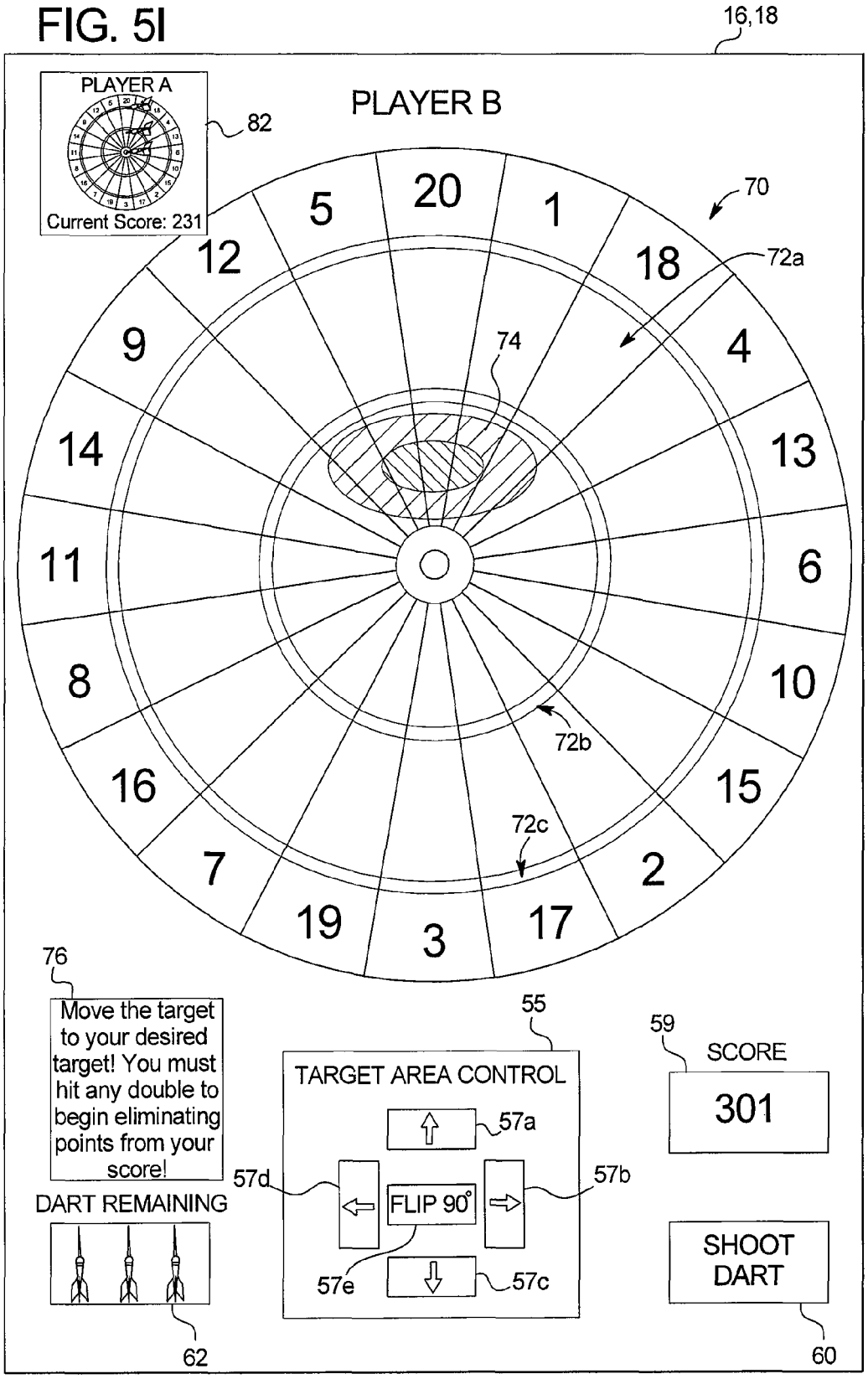

Now, Player B has the opportunity to throw three darts. FIG. 5I illustrates the screen that Player B sees at his or her gaming device at the beginning of Player B's first turn. The gaming device displays the outcome of Player A's turn in display window 82, so that Player B can visually see how Player A performed in the first turn. Player B will throw the three darts to complete his or her turn, as described above. The game continues in this manner (i.e., the players alternate taking turns and shooting three darts in each turn) until one of the players obtains a score of zero or until one of the players elects to stop playing.

It should be appreciated that the game may end or terminate in any suitable manner. For example, in other embodiments, the objective is to get the highest number of points in a certain amount of time or after a certain number of rounds, or to be the first player to achieve any other suitable decisive event.

In an alternative embodiment, players play the game as a team against another player or team of players. The players on the team accumulate points or achieve an outcome together. In this embodiment, the team's overall score or ranking in the game depends on the performance of each of the players on that team. The gaming system determines and provides a game outcome for each team. In one embodiment, each of the teams plays the game independently and each team member individually receives the same award for the game. In another embodiment, each of the players plays the game independently of all of the other players. It should be appreciated that the game may award the members of the same team the same or different outcomes or awards for the game.

In one embodiment, the gaming system is operable over a wireless network, such as part of a wireless gaming system. In this embodiment, the player station may be a hand held device, a mobile device or any other suitable wireless device that enables a player to play any suitable game at a variety of different locations. It should be appreciated that a player station may be a device that has obtained approval from a regulatory gaming commission or a device that has not obtained approval from a regulatory gaming commission.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is hereby claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive, from a player, a wager to initiate a game;

(b) display a plurality of selectable outcomes for a game event, wherein each of a plurality of said plurality of selectable outcomes is displayed in association with one of a plurality of different award values;

(c) display an outcome selector distinct from the display of the plurality of selectable outcomes, the outcome selector including a primary area and a secondary area;

(d) receive, from the player, a selection of a primary outcome and one or more secondary outcomes based on a location of the displayed outcome selector, the primary outcome being associated with the primary area of the displayed outcome selector and the one or more secondary outcomes being associated with the secondary area of the displayed outcome selector; and (e) after the player has selected the primary outcome and the one or more secondary outcomes:

(i) for each of: (A) the primary outcome, and (B) the one or more secondary outcomes, associate one of a plurality of different probabilities of occurring in the game event with said outcome based on said player's selection of said primary outcome and said one or more secondary outcomes;

(ii) randomly determine which of said plurality of selectable outcomes actually occurs in the game event based on the respective probabilities associated with the primary outcome and the one or more secondary outcomes;

(iii) after randomly determining which of said plurality of selectable outcomes actually occurs, determine any award to be provided to the player based on any award value associated with the outcome which actually occurs; and (iv) cause any determined award to be provided to the player.

2. The gaming system of claim 1, wherein the probability of occurring associated with the primary outcome is different than the probability of occurring associated with each of the one or more secondary outcomes.

3. The gaming system of claim 2, wherein the probability of occurring associated with the primary outcome is higher than the probability of occurring associated with each of the one or more secondary outcomes.

4. The gaming system of claim 2, wherein the one or more secondary outcomes include a plurality of secondary outcomes, and the plurality of secondary outcomes are each associated with a same probability of occurring.

5. The gaming system of claim 2, wherein the one or more secondary outcomes include a plurality of secondary outcomes, and the plurality of secondary outcomes are each associated with a different probability of occurring.

6. The gaming system of claim 2, wherein the one or more secondary outcomes include a plurality of secondary outcomes, and the probabilities of occurring associated with a plurality of, but fewer than all of, the plurality of secondary outcomes are different from one another.

7. The gaming system of claim 1, wherein the probabilities of occurring associated with the primary outcome and the one or more secondary outcomes are selected from the group consisting of: (i) randomly determined probabilities, (ii) predetermined probabilities, and (iii) probabilities determined based on the wager made by the player.

8. The gaming system of claim 1, wherein for each of: (A) the primary outcome, and (B) the one or more secondary outcomes, the probability of occurring associated with said outcome is determined based on any award value associated with said outcome.

9. A gaming system comprising:

at least one display device;

at least one input device;

at least one processor; and at least one memory device which stores a plurality of instructions, which when executed by the at least one processor cause the at least one processor to operate with the at least one display device and the at least one input device to:

(a) receive, from a player, a wager to initiate a game;

(b) display a plurality of selectable outcomes for a game event, wherein each of a plurality of said plurality of selectable outcomes is displayed in association with one of a plurality of different award values;

(c) display an outcome selector distinct from the display of the plurality of selectable outcomes, the outcome selector including a primary area and a secondary area;

(d) receive, from the player, a selection of at least one primary outcome and one or more secondary outcomes based on a location of the displayed outcome selector, the at least one primary outcome being associated with the primary area of the displayed outcome selector and the one or more secondary outcomes being associated with the secondary area of the displayed outcome selector; and (e) after the player has selected said at least one primary outcome and said one or more secondary outcomes:

(i) for each of: (A) the at least one primary outcome, and (B) the one or more secondary outcomes, associate one of a plurality of different probabilities of occurring in the game event with said outcome based on said player's selection of said at least one primary outcome and said one or more secondary outcomes;

(ii) randomly determine which of the plurality of selectable outcomes actually occurs in the game event based on the respective probabilities associated with the at least one primary outcome and the one or more secondary outcomes;

(iii) after randomly determining which of said plurality of selectable outcomes actually occurs, determine any award to be provided to the player based on any award value associated with the outcome which actually occurs; and (iv) cause any determined award to be provided to the player.

10. The gaming system of claim 9, wherein the probability of occurring associated with each of the at least one primary outcome is different than the probability of occurring associated with each of the one or more secondary outcomes.

11. The gaming system of claim 10, wherein the probability of occurring associated with each of the at least one primary outcome is higher than the probability of occurring associated with each of the one or more secondary outcomes.

12. The gaming system of claim 9, wherein the one or more secondary outcomes include a plurality of secondary outcomes, and the plurality of secondary outcomes are each associated with a same probability of occurring.

13. The gaming system of claim 9, wherein the one or more secondary outcomes include a plurality of secondary outcomes, and the plurality of secondary outcomes are each associated with a different probability of occurring.

14. The gaming system of claim 9, wherein the one or more secondary outcomes include a plurality of secondary outcomes, and the probabilities of occurring associated with a plurality of, but fewer than all of, the plurality of secondary outcomes are different from one another.

15. The gaming system of claim 9, wherein the probabilities of occurring associated with the at least one primary outcome and the one or more secondary outcomes are selected from the group consisting of: (i) randomly determined probabilities, (ii) predetermined probabilities, and (iii) probabilities determined based on the wager made by the player.

16. The gaming system of claim 9, wherein for each of: (A) the at least one primary outcome, and (B) the one or more secondary outcomes, the probability of occurring associated with said outcome is determined based on any award value associated with said outcome.

17. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) receive, from a player, a wager to initiate a game;

(b) display a plurality of selectable targets for a game event, wherein each of a plurality of said plurality of selectable targets is displayed in association with one of a plurality of different award values;

(c) display a target selector distinct from the display of the plurality of selectable targets, the target selector including a primary area and a secondary area;

(d) receive, from the player, a selection of a primary target and one or more secondary targets based on a location of the displayed target selector, the primary target being associated with the primary area of the displayed target selector and the one or more secondary targets being associated with the secondary area of the displayed target selector; and (e) after the player selects said primary target and said one or more secondary targets:

(i) for each of: (A) the primary target, and (B) the one or more secondary targets, associate one of a plurality of different probabilities of being hit in said game event with said target based on said player's selection of said primary target and said one or more secondary targets;

(ii) display a game event outcome which includes one of said plurality of selectable targets being hit, wherein the target that is hit in the game event outcome is randomly determined based on the respective probabilities associated with the primary target and the one or more secondary targets;

(iii) determine any award to be provided to the player based on any award value associated with the target that is hit in the game event; and (iv) cause any determined award to be provided to the player.

18. The gaming system of claim 17, wherein the probability of being hit associated with the primary target is higher than the probability of being hit associated with each of said one or more secondary targets.

19. The gaming system of claim 17, wherein the one or more secondary targets include a plurality of secondary targets, and the probability of being hit associated with the primary target is higher than the probability of being hit associated with each of the plurality of secondary targets.

20. The gaming system of claim 17, wherein the one or more secondary targets include a plurality of secondary targets, and the plurality of secondary targets are each associated with a same probability of being hit.

21. The gaming system of claim 17, wherein the one or more secondary targets include a plurality of secondary targets, and the plurality of secondary targets are each associated with a different probability of being hit.

22. The gaming system of claim 17, wherein the probabilities of being hit associated with the primary target and the one or more secondary targets are selected from the group consisting of: (i) randomly determined probabilities, (ii) predetermined probabilities, and (iii) probabilities determined based on the wager made by the player.

23. The gaming system of claim 22, wherein said processor is operable to modify said target selector based on: (i) the wager placed by the player, (ii) a skill level of the player, (iii) time, and (iv) any combination of these.

24. The gaming system of claim 22, wherein said processor is operable to enable the player to modify said target selector.

25. The gaming system of claim 17, wherein for each of: (A) the primary target, and (B) the one or more secondary targets, the probability of being hit associated with said target is determined based on any award value associated with said target.

26. A method of operating a gaming system including at least one memory device which stores a plurality of instructions, said method comprising:

(a) causing at least one processor to execute the plurality of instructions to operate with at least one input device to receive, from a player, a wager to initiate a game;

(b) causing at least one display device to display a plurality of selectable outcomes for a game event, wherein each of a plurality of said plurality of selectable outcomes is displayed in association with one of a plurality of different award values;

(c) causing the at least one display device to display an outcome selector distinct from the display of the plurality of selectable outcomes, the outcome selector including a primary area and a secondary area;

(d) causing the at least one processor to execute the plurality of instructions to operate with the at least one input device to receive, from the player, a selection of a primary outcome and one or more secondary outcomes based on a location of the displayed outcome selector, the primary outcome being associated with the primary area of the displayed outcome selector and the one or more secondary outcomes being associated with the secondary area of the displayed outcome selector; and (e) after receiving the player's selection of said primary outcome and said one or more secondary outcomes:

(i) causing the at least one processor to execute the plurality of instructions to, for each of: (A) the primary outcome, and (B) the one or more secondary outcomes, associate one of a plurality of different probabilities of occurring in the game event with said outcome based on said player's selection of said primary outcome and said one or more secondary outcomes;

(ii) causing the at least one processor to execute the plurality of instructions to randomly determine which of said plurality of selectable outcomes actually occurs in the game event based on the respective probabilities associated with the primary outcome and the one or more secondary outcomes;

(iii) after randomly determining which of said plurality of selectable outcomes actually occurs, causing the at least one processor to execute the plurality of instructions to determine any award to be provided to the player based on any award value associated with the outcome which actually occurs; and (iv) causing any determined award to be provided to the player.

27. The method of claim 26, wherein the probability of occurring associated with the primary outcome is different than the probability of occurring associated with each of the one or more secondary outcomes.

28. The method of claim 26, wherein the probability of occurring associated with the primary outcome is higher than the probability of occurring associated with each of the one or more secondary outcomes.

29. The method of claim 26, wherein the one or more secondary outcomes include a plurality of secondary outcomes, and the plurality of secondary outcomes are each associated with a same probability of occurring.

30. The method of claim 26, wherein the one or more secondary outcomes include a plurality of secondary outcomes, and the plurality of secondary outcomes are each associated with a different probability of occurring.

31. The method of claim 26, wherein the one or more secondary outcomes include a plurality of secondary outcomes, and the probabilities of occurring associated with a plurality of, but fewer than all of, the plurality of secondary outcomes are different from one another.

32. The method of claim 26, which includes selecting the probabilities of occurring associated with the primary outcome and the one or more secondary outcomes from the group consisting of: (i) randomly determined probabilities, (ii) predetermined probabilities, and (iii) probabilities determined based on the wager made by the player.

33. The method of claim 26, which is provided to the player through a data network.

34. The method of claim 33, wherein the data network is an internet.

35. The method of claim 26, wherein for each of: (A) the primary outcome, and (B) the one or more secondary outcomes, the probability of occurring associated with said outcome is determined based on any award value associated with said outcome.

36. A method of operating a gaming system including at least one memory device which stores a plurality of instructions, said method comprising:

(a) causing at least one processor to execute the plurality of instructions to operate with at least one input device to receive, from a player, a wager to initiate a game;

(b) causing at least one display device to display a plurality of selectable outcomes for a game event, wherein each of a plurality of said plurality of selectable outcomes is displayed in association with one of a plurality of different award values;

(c) causing the at least one display device to display an outcome selector distinct from the display of the plurality of selectable outcomes, the outcome selector including a primary area and a secondary area;

(d) causing the at least one processor to execute the plurality of instructions to operate with the at least one input device to receive, from the player, a selection of at least one primary outcome and one or more secondary outcomes based on a location of the displayed outcome selector, the at least one primary outcome being associated with the primary area of the displayed outcome selector and the one or more secondary outcomes being associated with the secondary area of the displayed outcome selector; and (e) after the player selects said at least one primary outcome and said one or more secondary outcomes:

(i)) causing the at least one processor to execute the plurality of instructions to, for each of: (A) the at least one primary outcome, and (B) the one or more secondary outcomes, associate one of a plurality of different probabilities of occurring in the game event with said outcome based on said player's selection of said at least one primary outcome and said one or more secondary outcomes;

(ii) causing the at least one processor to execute the plurality of instructions to randomly determine which of said plurality of selectable outcomes actually occurs in the game event based on the respective probabilities associated with the at least one primary outcome and the one or more secondary outcomes;

(iii) after randomly determining which of said plurality of selectable outcomes actually occurs, causing the at least one processor to execute the plurality of instructions to determine any award to be provided to the player based on any award value associated with the outcome which actually occurs; and (iv) causing any determined award to be provided to the player.

37. The method of claim 36, wherein the probability of occurring associated with each of the at least one primary outcome is different than the probability of occurring associated with each of the one or more secondary outcomes.

38. The method of claim 36, wherein the probability of occurring associated with each of the at least one primary outcome is higher than the probability of occurring associated with each of the one or more secondary outcomes.

39. The method of claim 36, wherein the one or more secondary outcomes include a plurality of secondary outcomes, and the plurality of secondary outcomes are each associated with a same probability of occurring.

40. The method of claim 36, wherein the one or more secondary outcomes include a plurality of secondary outcomes, and the plurality of secondary outcomes are each associated with a different probability of occurring.

41. The method of claim 36, wherein the one or more secondary outcomes include a plurality of secondary outcomes, and the probabilities of occurring associated with a plurality of, but fewer than all of, the plurality of secondary outcomes are different from one another.

42. The method of claim 36, which includes selecting the probabilities of occurring associated with the at least one primary outcome and the one or more secondary outcomes from the group consisting of: (i) randomly determined probabilities, (ii) predetermined probabilities, and (iii) probabilities determined based on the wager made by the player.

43. The method of claim 36, which is provided to the player through a data network.

44. The method of claim 43, wherein the data network is an internet.

45. The method of claim 36, wherein for each of: (A) the at least one primary outcome, and (B) the one or more secondary outcomes, the probability of occurring associated with said outcome is determined based on any award value associated with said outcome.

46. A method of operating a gaming system including at least one memory device which stores a plurality of instructions, said method comprising:

(a) causing at least one processor to execute the plurality of instructions to operate with at least one input device to receive, from a player, a wager to initiate a game;

(b) causing at least one display device to display a plurality of selectable targets for a game event, wherein each of a plurality of said plurality of selectable targets is displayed in association with one of a plurality of different award values;

(c) causing the at least one display device to display a target selector distinct from the display of the plurality of selectable targets, the target selector including a primary area and a secondary area (d) causing the at least one processor to execute the plurality of instructions to operate with the at least one input device to receive, from the player, a selection of a primary target and one or more secondary targets based on a location of the displayed target selector, the primary target being associated with the primary area of the displayed target selector and the one or more secondary targets being associated with the secondary area of the displayed target selector; and (e) after receiving the player's selection of said primary target and said one or more secondary targets:

(i) causing the at least one processor to execute the plurality of instructions to, for each of: (A) the primary target, and (B) the one or more secondary targets, associate one of a plurality of different probabilities of being hit in said game event with said target based on said player's selection of said primary target and said one or more secondary targets;

(ii) causing the at least one display device to display a game event outcome which includes one of said plurality of selectable targets being hit, wherein the target that is hit in the game event outcome is randomly determined based on the respective probabilities associated with the primary target and the one or more secondary targets;

(iii) causing the at least one processor to execute the plurality of instructions to determine any award to be provided to the player based on any award value associated with the target that is hit in the game event; and (iv) causing any determined award to be provided to the player.

47. The method of claim 46, wherein the probability of being hit associated with the primary target is higher than the probability of being hit associated with each of said one or more secondary targets.

48. The method of claim 46, wherein the one or more secondary targets include a plurality of secondary targets, and the probability of being hit associated with the primary target is higher than the probability of being hit associated with each of the plurality of secondary targets.

49. The method of claim 46, wherein the one or more secondary targets include a plurality of secondary targets, and the plurality of secondary targets are each associated with a same probability of being hit.

50. The method of claim 46, wherein the one or more secondary targets include a plurality of secondary targets, and the plurality of secondary targets are each associated with a different probability of being hit.

51. The method of claim 46, wherein the probabilities of being hit associated with the primary target and the one or more secondary targets are predetermined.

52. The method of claim 46, which includes causing the at least one processor to execute the plurality of instructions to determine the probabilities of being hit associated with the primary target and the one or more secondary targets based on the player's wager.

53. The method of claim 46, which includes causing the at least one processor to execute the plurality of instructions to modify the target selector based on: (i) the wager placed by the player, (ii) a skill level of the player, (iii) time, and (iv) any combination of these.

54. The method of claim 46, which includes enabling the player to modify the target selector.

55. The method of claim 46 which is provided through a data network.

56. The method of claim 55, wherein the data network is an internet.

57. The method of claim 46, wherein for each of: (A) the primary target, and (B) the one or more secondary targets, the probability of being hit associated with said target is determined based on any award value associated with said target.

* * * * *